US008954205B2

(12) United States Patent
Sagar et al.

(10) Patent No.: US 8,954,205 B2
(45) Date of Patent: Feb. 10, 2015

(54) SYSTEM AND METHOD FOR ROAD SIDE EQUIPMENT OF INTEREST SELECTION FOR ACTIVE SAFETY APPLICATIONS

(71) Applicants: Katta Vidya Sagar, Bangalore (IN); Faroog Ibrahim, Dearborn Heights, MI (US)

(72) Inventors: Katta Vidya Sagar, Bangalore (IN); Faroog Ibrahim, Dearborn Heights, MI (US)

(73) Assignee: Savari, Inc., Santa Clara, CA (US)

( * ) Notice: Subject to any disclaimer, the term of this patent is extended or adjusted under 35 U.S.C. 154(b) by 0 days.

(21) Appl. No.: 14/163,258

(22) Filed: Jan. 24, 2014

(65) Prior Publication Data

US 2014/0358324 A1 Dec. 4, 2014

Related U.S. Application Data

(63) Continuation-in-part of application No. 14/047,157, filed on Oct. 7, 2013, which is a continuation of application No. 13/907,862, filed on Jun. 1, 2013, now Pat. No. 8,892,347, and a continuation-in-part of application No. 13/907,864, filed on Jun. 1, 2013.

(51) Int. Cl.
*G08G 1/00* (2006.01)

(52) U.S. Cl.
CPC ..... *G08G 1/00* (2013.01)
USPC ..... 701/1

(58) Field of Classification Search
USPC ..... 701/1
See application file for complete search history.

(56) References Cited

U.S. PATENT DOCUMENTS

| | | | | |
|---|---|---|---|---|
| 5,229,941 | A * | 7/1993 | Hattori | 701/26 |
| 6,751,535 | B2 * | 6/2004 | Mori | 701/23 |
| 7,979,172 | B2 * | 7/2011 | Breed | 701/23 |
| 7,979,173 | B2 * | 7/2011 | Breed | 701/23 |
| 7,990,283 | B2 * | 8/2011 | Breed | 340/903 |
| 8,126,642 | B2 * | 2/2012 | Trepagnier et al. | 701/423 |
| 8,280,623 | B2 * | 10/2012 | Trepagnier et al. | 701/301 |
| 8,412,449 | B2 * | 4/2013 | Trepagnier et al. | 701/301 |
| 8,457,827 | B1 * | 6/2013 | Ferguson et al. | 701/23 |
| 8,521,352 | B1 * | 8/2013 | Ferguson et al. | 701/25 |
| 8,527,199 | B1 * | 9/2013 | Burnette et al. | 701/450 |
| 8,618,922 | B2 * | 12/2013 | Debouk et al. | 340/439 |
| 2012/0022776 | A1 * | 1/2012 | Razavilar | 701/200 |
| 2013/0260759 | A1 * | 10/2013 | Choi et al. | 455/436 |

* cited by examiner

*Primary Examiner* — Mary Cheung
*Assistant Examiner* — Anne Mazzara
(74) *Attorney, Agent, or Firm* — Maxvalueip LLC

(57) ABSTRACT

In one example, we describe a method and infrastructure for DSRC V2X (vehicle to infrastructure plus vehicle) system. In one example, some of connected vehicle applications require data from infrastructure road side equipment (RSE). Examples of such applications are road intersection safety application which mostly requires map and traffic signal phase data to perform the appropriate threat assessment. The examples given cover different dimensions of the above issue: (1) It provides methods of RSE of interest selection based solely on the derived relative geometric data between the host vehicle and the RSE's, in addition to some of the host vehicle data, such as heading. (2) It provides methods of RSE of interest selection when detailed map data is communicated or when some generic map data is available. (3) It provides methods of RSE of interest selection when other vehicles data is available. Other variations and cases are also given.

28 Claims, 34 Drawing Sheets

SYSTEM AND METHOD FOR ROAD SIDE EQUIPMENT OF INTEREST SELECTION FOR ACTIVE SAFETY APPLICATIONS

RELATED APPLICATIONS

This application is a CIP of another co-pending US utility application, namely, Ser. No. 14/047,157, titled "System and method for map matching", filed 7 Oct. 2013, which in turn is a CIP of two other co-pending US utility applications, namely, Ser. No. 13/907,864, titled "System and method for lane boundary estimation and host vehicle position and orientation", filed 1 Jun. 2013, and Ser. No. 13/907,862, titled "System and method for node adaptive filtering and congestion control for safety and mobility applications toward automated vehicles system", filed 1 Jun. 2013. It is also related to another US patent application filed on about the same day, 14/163,478, with the same inventors and assignee, titled "System and method for creating, storing, and updating local dynamic MAP database with safety attribute". The teachings of all the above applications are incorporated herein, by reference. The current application claims the priority date of the above applications.

BACKGROUND OF THE INVENTION

One aspect of the present invention relates to a system that uses the Vehicle to Vehicle (V2V) and/or the Vehicle to infrastructure communication for safety and mobility applications. The invention provides methods and systems to make the V2X realized and effectively used in any intelligent transportation system toward automated vehicle system.

Dedicated Short Range Communication (DSRC) is the main enabling technology for connected vehicle applications that will reduce vehicle crashes through fully connected transportation system with integrated wireless devices and road infrastructure. In such connected system, data among vehicles and with road infrastructure will be exchanged with acceptable time delay. DSRC is the enabler for the V2X communication and provides 360 degrees field of view with long range detection/communication capability up to 1000 meter. Data such as vehicle position, dynamics and signals can be exchanged among vehicles and road side equipments which make the deployment of safety applications such as crash avoidance systems (warning and control) possible. V2X technology will complement and get fused with the current production crash avoidance technologies that use radar and vision sensing. V2V will give drivers information needed for safer driving (driver makes safe decisions) on the road that radar and vision systems cannot provide. This V2X capability, therefore, offers enhancements to the current production crash avoidance systems, and also enables addressing more complex crash scenarios, such as those occurring at intersections. This kind of integration between the current production crash avoidance systems, V2X technology, and other transportation infrastructure paves the way for realizing automated vehicles system.

The safety, health, and cost of accidents (on both humans and properties) are major concerns for all citizens, local and Federal governments, cities, insurance companies (both for vehicles and humans), health organizations, and the Congress (especially due to the budget cuts, in every level). People inherently make a lot of mistakes during driving (and cause accidents), due to the lack of sleep, various distractions, talking to others in the vehicle, fast driving, long driving, heavy traffic, rain, snow, fog, ice, or too much drinking. If we can make the driving more automated by implementing different scale of safety applications and even controlling the motion of the vehicle for longer period of driving, that saves many lives and potentially billions of dollars each year, in US and other countries. We introduce here an automated vehicle infrastructure and control systems and methods. That is the category of which the current invention is under, where V2X communication technology is vital component of such system, with all the embodiments presented here and in the divisional cases, in this family.

Some of connected vehicle applications require data from infrastructure road side equipment (RSE). Examples of such applications are road intersection safety application which mostly requires map and traffic signal phase data to perform the appropriate threat assessment. RSE's DSRC communication range can effectively reach 800 m, as an example. RSE's physical locations selection is driven by the desired traffic safety/mobility functionality for the specific road segments of interest. As a result, it is possible that the communication range of the different RSEs will overlap. On the safety application side, say, e.g., inside the on-board unit (OBU) integrated in the vehicle, it is highly possible that the OBU is receiving data from more than one RSE. Therefore, for the safety application to perform correctly, it is essential to use the RSE data that is associated to the anticipated vehicle travel trajectory. For this intended operation to happen, the algorithm is required to select the RSE of interest for the desired active safety application. We address all of these here in our invention, as described in details below.

Some of the prior art, listed here (some US patents), discusses some of the issues for the control of the cars, but none of them has any solution similar to ours, as described in details below:

a. U.S. Pat. No. 8,618,922, Method and system for ensuring operation of limited-ability autonomous driving vehicles
b. U.S. Pat. No. 8,527,199, Automatic collection of quality control statistics for maps used in autonomous driving
c. U.S. Pat. No. 8,521,352, Controlling a vehicle having inadequate map data
d. U.S. Pat. No. 8,457,827, Modifying behavior of autonomous vehicle based on predicted behavior of other vehicles
e. U.S. Pat. No. 8,412,449, Control and systems for autonomously driven vehicles
f. U.S. Pat. No. 8,280,623, Control and systems for autonomously driven vehicles
g. U.S. Pat. No. 8,126,642, Control and systems for autonomously driven vehicles
h. U.S. Pat. No. 7,979,173, Autonomous vehicle travel control systems and methods
i. U.S. Pat. No. 7,979,172, Autonomous vehicle travel control systems and methods
j. U.S. Pat. No. 6,751,535, Travel controlling apparatus of unmanned vehicle
k. U.S. Pat. No. 5,229,941, Autonomous vehicle automatically running on route and its method

SUMMARY OF THE INVENTION

DSRC, such as WiFi, is used here, in one embodiment. In one embodiment, DSRC V2X (vehicle to infrastructure plus vehicle) System can cover a communication circle up to 800 m, and in some cases 1000 meter, and as a result, in congested traffic areas, the on-board unit is communicating with high number of units and may end up saturating its processing capability very quickly.

This invention covers different dimensions of the above problem, in different embodiments:

1—It provides methods of RSE of interest selection based solely on the derived relative geometric data between the host vehicle and the RSE's, in addition to some of the host vehicle data, such as heading.

2—It provides methods of RSE of interest selection when detailed map data is communicated or when some generic map data is available.

3—It provides methods of RSE of interest selection when other vehicles data is available.

4—It provides method to lock on a specific RSE, release the lock on the specific RSE, and transit the lock to a different RSE.

5—Incorporate the security validation factor in the RSE selection.

There are different Factors affecting the RSE of interest selection decision:

Number of RSE's the vehicle is able to receive data from (listen).

Type of data the RSE is transmitting/ supporting. (Example: if it sends map data.)

Location of the RSE.

Security Validation of the RSE-certificates.

Vehicle location and dynamics.

Location of other Vehicles, near the (Host) Vehicle.

Using our method and system, due to many reasons, as shown below, including efficiency, reliability, and safety, our invention here is superior to the prior art.

DETAILED DESCRIPTION OF THE PREFERRED EMBODIMENTS

In one embodiment, the following steps describe the high level algorithm of the RSE selection: (see e.g. FIG. 26)

1. RSE-Filtering. Different type of filtering based on Range and Cross-Range of the RSE.
2. Check for duplicates in the RSE list, and modify the RSE-list accordingly.
3. Determine Locations of interest based on HV and RV(s) Location and Dynamics.
4. Order all RSEs based on their locations and vehicle location and Dynamics.
5. In case of MAP message availability, modify the RSE's Order according to the relevance of the RSE based on MAP message.
6. Based on the Above RSE order, and current RSE (listening), decide whether to continue using existing RSE or switch to a different RSE.

The following describes the details of each step, as one embodiment:

1—RSE Filtering:

In one embodiment, the RSE(s) of least relevance will be eliminated in this Step. The Filtration is based on the Cross-Range of the RSE.

1—Whenever the Host-Vehicle system is configured, use only security-validated RSE(s). Check for Security Validation of the RSE-Certificates. In case any of the RSE fails to pass them, ignore/negate the RSE from further processing.

2—For each of the RSE, calculate RSE values, such as Separation distance, Cross-range, down-range, cross-track, Relative-Heading. (see e.g. FIG. 27)

Range: $L=\sqrt{(\Delta North^2+\Delta East^2)}$

Or $L=SQRT\ (\Delta North^2+\Delta East^2)$ (for square-root)

Relative-Heading: $\phi=\arctan\ (\Delta East, \Delta North)$

Corresponding to X and Y axes, as horizontal and vertical axes, for 2D (2-dimensional) orthogonal coordinates, respectively.

Where the arctan gives an angle between e.g. −180 to 180 degrees.

Projecting L on its components, based on angle $\phi$:

Down-Range: $L_d=L*\cos\phi$

Cross-Range: $L_c=L*\sin\phi$

Where:

$\Delta East=East_{RSE}-East_{vehicle}$ $\Delta North=North_{RSE}-North_{vehicle}$ 3—Remove all the RSE(s) which have Cross-Range greater than $d_{CR}$, e.g. 100 m (or meters); and proceed for further steps with rest of the RSE(s). The value of $d_{CR}$ in one embodiment is a fraction or a multiple of the range of communication device or a specific communication technology range specification.

4—In case there are more than 2 RSE(s) at this stage, Filter/Remove the RSE(s) which have a range (between host vehicle and each RSE) of greater than $d_{R1}$, e.g. 500 m. (In case there are less than 2 RSEs at this stage, revert the filter.) The value of $d_{R1}$ in one embodiment is in the order of (or a multiple of) the range of communication device or a specific communication technology range specification.

Figure 18:
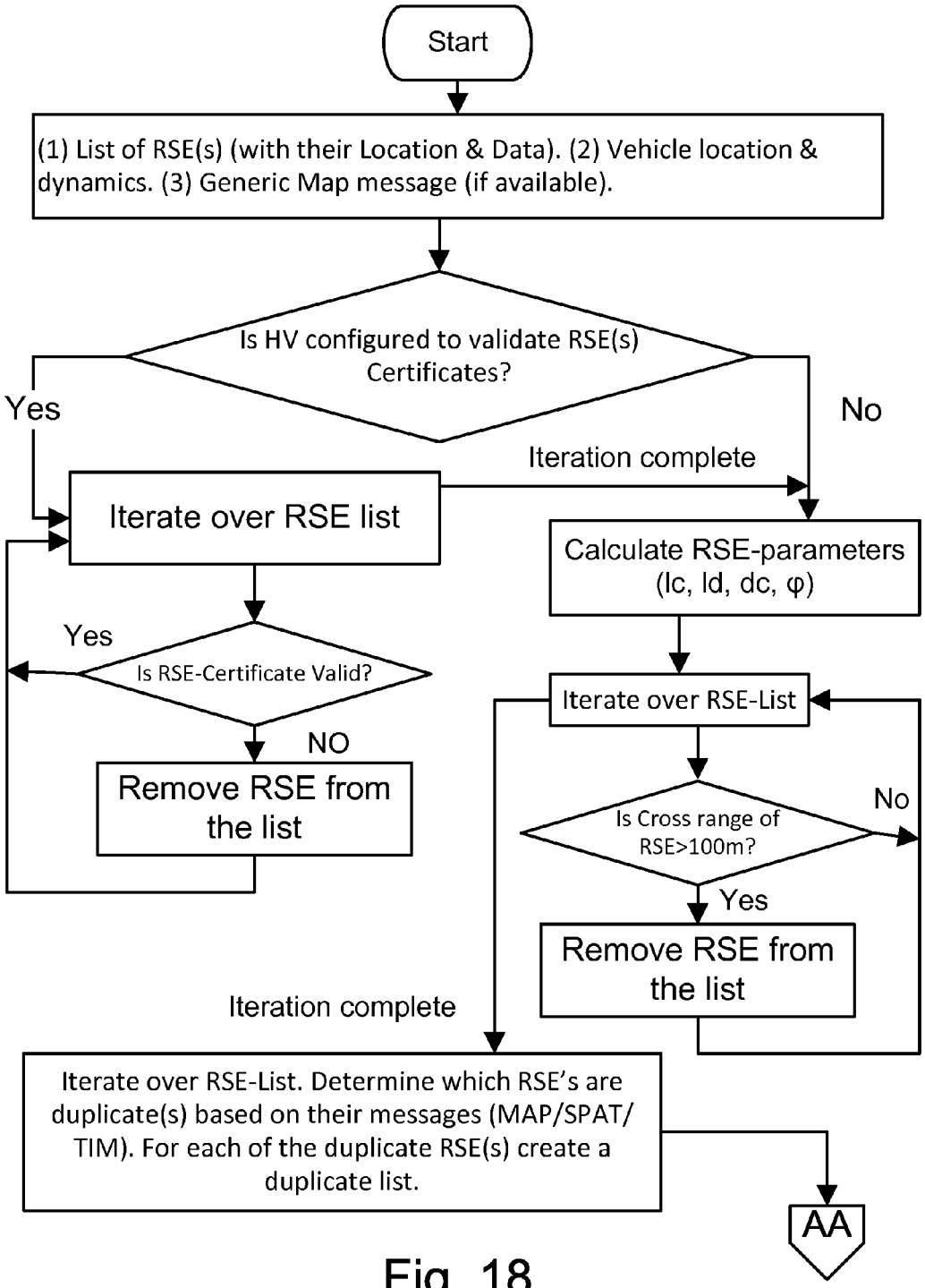
FIG. 18 is for one embodiment of the invention, for a method of RSE of interest selection for active safety applications.

2—Detection and Filtering of Duplicate RSE(s):

In one embodiment (see e.g. FIG. 18), duplicate RSE(s) are the ones which transmit the same messages irrespective of their locations. The idea here is to remove the redundancy of the data at the safety application side. In such case, it does not really make much of a difference from Safety Applications point of view which RSE needs to be picked up. Hence, we discount all but one of these RSE for reduction in computations.

1—Process all the RSE's and check if the Message(s) sent by them are the same for any 2 or more of the RSE(s).

2—Of the RSE(s) which have been detected to contain same message(s), store these RSEs into a duplicate list for further processing.

Figure 19:
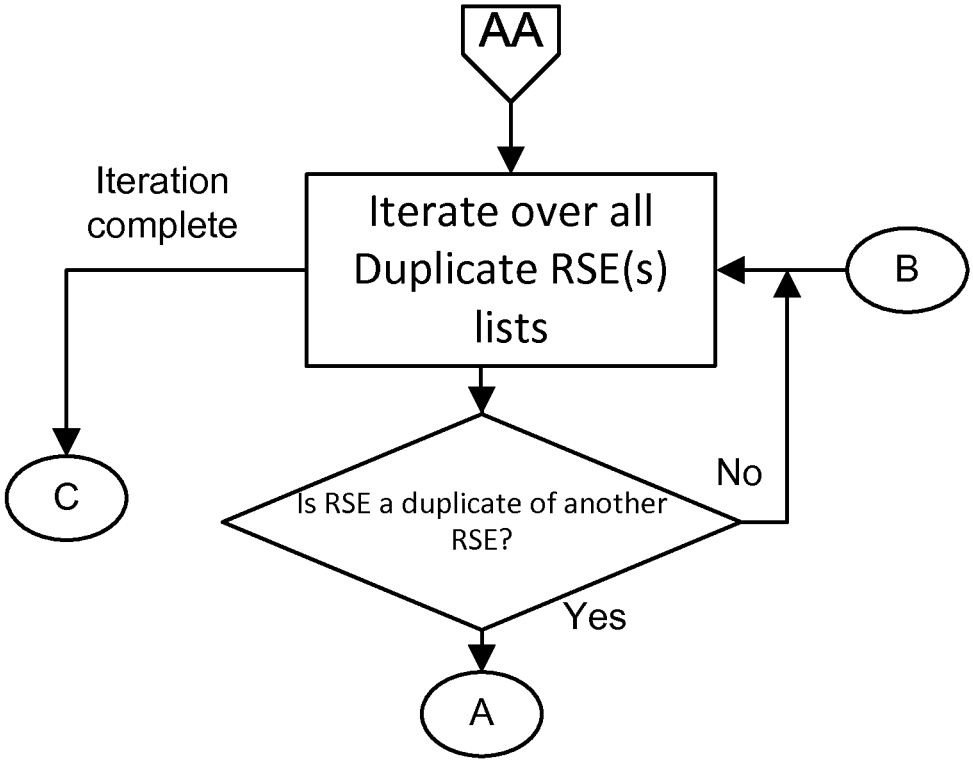
FIG. 19 is for one embodiment of the invention, for a method of RSE of interest selection for active safety applications.

3—Of the RSE(s) in each of the Duplicate List (see e.g. FIG. 19), pick one RSE as the primary RSE, based on the following conditions (whichever satisfies the condition first).

Distance from the vehicle is less than $d_1$, e.g. 100 m. (Condition1)). The value of $d_1$ in one embodiment is a fraction of the range of communication device or a specific communication technology range specification.

Cross-Range of the RSE (w.r.t. host Vehicle) is less than $d_2$, e.g. 30 m (approximately e.g. 6 lanes+8 m buffer, or $N_1$ lanes plus $d_3$ buffer). (Condition 2) The values of $d_2$ and $d_3$ in one embodiment are a multiple of the average size or length of a vehicle, or a fraction of the average width of a highway.

Iteratively check for either Condition1 (or) Condition 2, above, by adding either e.g. $d_4$ or 100 m to Range, or e.g. $d_5$ or 30 m to Cross-Range. The value of $d_5$ or $d_4$ in one embodiment is a fraction of the range of communication device or a specific communication technology range specification.

3—Detection of Points of Interest (Based on RV(s) and HV Intersecting Paths):

In one embodiment, this step would be processed when we have information related to the Remote-Vehicles (RV). We can use this information to determine points of interest. These points of interest would be used in latter steps to determine presence of RSE(s) near to them, and increase the priority of these RSE(s) relative to other RSE(s). (see e.g. FIG. 28)

1—Process/Convert all RV(s) location within a region of interest and Heading angle, and convert them to values relative to Host Vehicle's (HV) Location and Heading angle.

2—For all the cases where RV is heading in a different direction with respect to HV, solve HV and RV paths equations to generate Intersecting point of these paths.

3—Of all these Intersection points, converge the sets of points which fall within e.g. $d_6$ or 50 m radius of each other. The value of $d_6$ in one embodiment is a fraction of the range of communication device or a specific communication technology range specification.

4—Of these intersection points, determine the location of them with respect to the host vehicle (e.g., whether it is Ahead or Behind of the Host-Vehicle).

5—In case multiple points are present, we can choose to ignore the locations which happen to be already traversed by the Remote-Vehicle.

6—Ignore all the locations which happen to fall behind the Host-Vehicle.

7—Of all the points which Fall ahead of Host Vehicle, pick the one which is closest to the Host-Vehicle (in terms of Down-Range).

4—Ordering RSE, Based on RSE-Location and Vehicle Dynamics.

In one embodiment, the Idea is to order all the RSE based on relevance of the RSE for the Vehicle using one or more of the following parameters:

RSE Location (if present)
Vehicle Location (if present)
Vehicle Heading
Vehicle Yaw-rate (if present)
Vehicle Speed & Acceleration (if present)

We have the following steps:

1—Determine whether there are any RSE(s) located near to Point-Of-Interest (determined in Step-3, based on Remote-Vehicle(s) location). If true, use these RSE attributes to filter other RSE(s):
Filter all RSE(s) having Down-Range greater than the Down-Range of RSE (POI).

2—Pick all the RSE(s) which have a down-range of less than e.g. $d_7$ or 50 m. The value of $d_7$ in one embodiment is a fraction of the range of communication device or a specific communication technology range specification.
Order these RSE(s) based on their Down-Ranges.
Place all these RSE(s) at the Top of the Relevance List.

3—For the Rest of the RSE(s), having down-range >50 m, or $d_7$, as an example, and Cross-Range of e.g. <30 m, or $d_5$, as an example, order the RSE(s) based on the following criteria:
Pick the RSEs which are present ahead of the Vehicle (+ve Down-Range), and append them in Relevance-List in ascending order of Down-Range.
Next pick the RSEs which are present behind the Vehicle (−ve Down-Range), and append them in Relevance-List in descending order of Down-Ranges.

Figure 20:
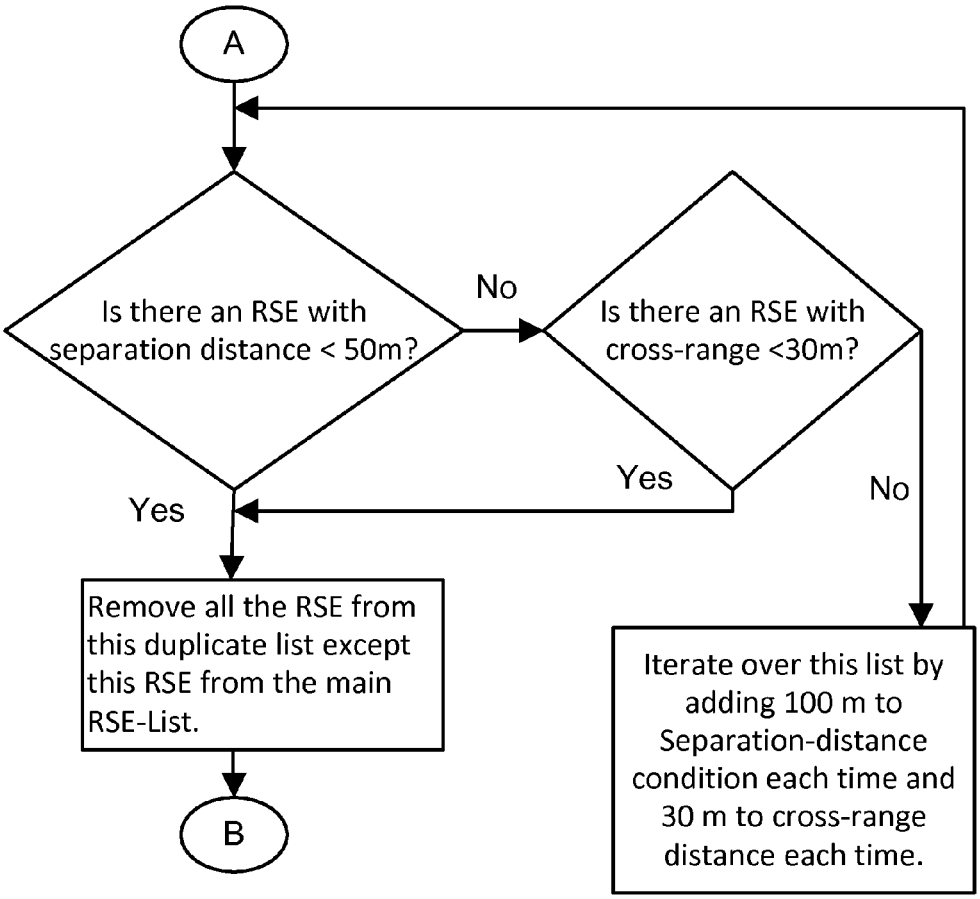
FIG. 20 is for one embodiment of the invention, for a method of RSE of interest selection for active safety applications.
Figure 21:
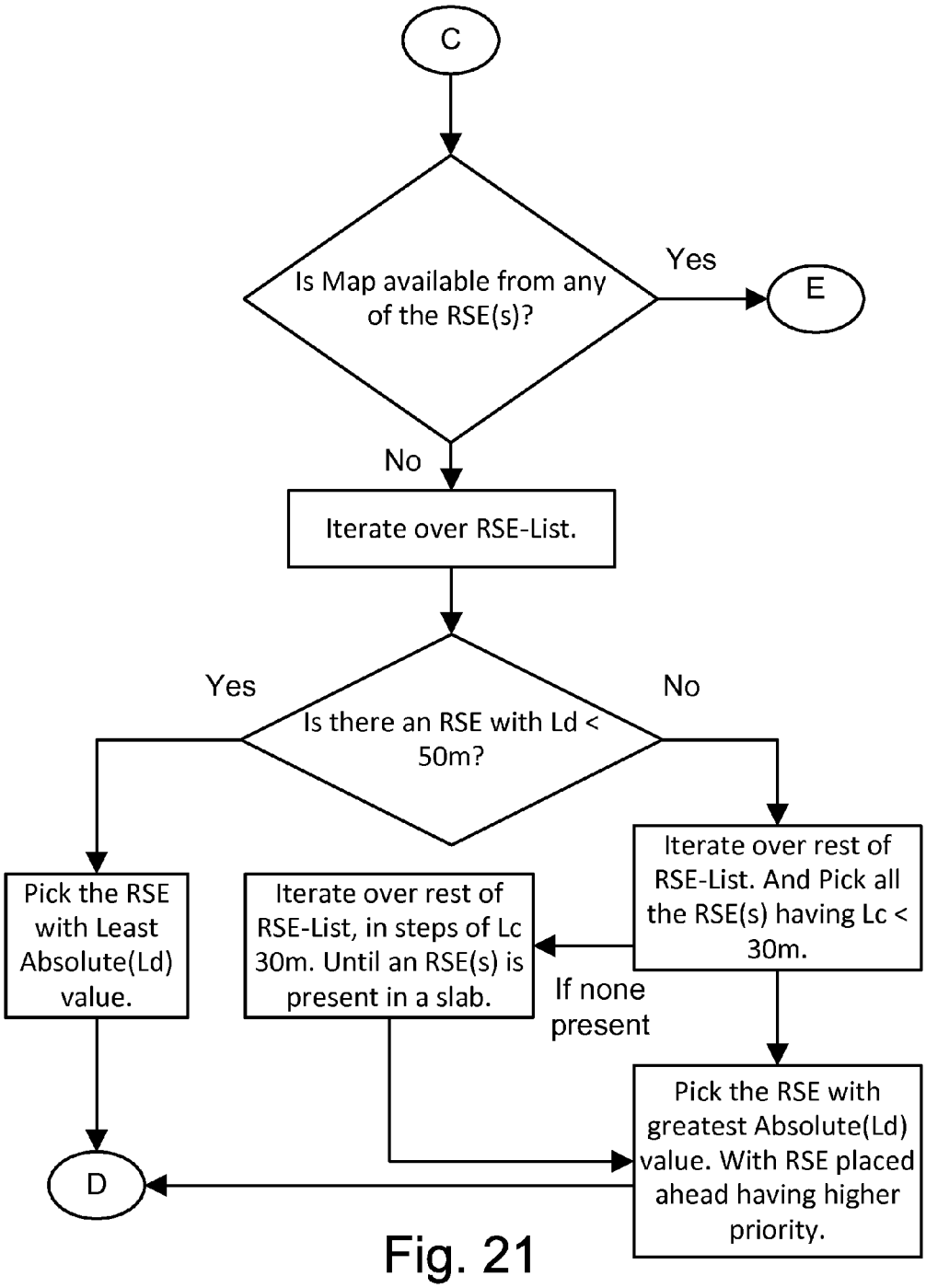
FIG. 21 is for one embodiment of the invention, for a method of RSE of interest selection for active safety applications.

4—For all the Rest of the RSE(s), order them iteratively using Step 2 (e.g. using a loop), by increasing Cross-Range in steps of e.g. 30 m, or $d_5$. (see, e.g., FIGS. 20 and 21.)

5—Ordering RSE Based on RSE-Location on MAP and Vehicle Dynamics.

In one embodiment, whenever the Vehicle has a MAP-Message, we would be utilizing the MAP message to determine the Relevance of each of the RSE, and ordering it based on relevance of the RSE. The relevance factor or score, $R_{score}$, e.g., can be between 0 to 100, or a fraction of 1, with maximum as 100 and 1, respectively.

Figure 22:
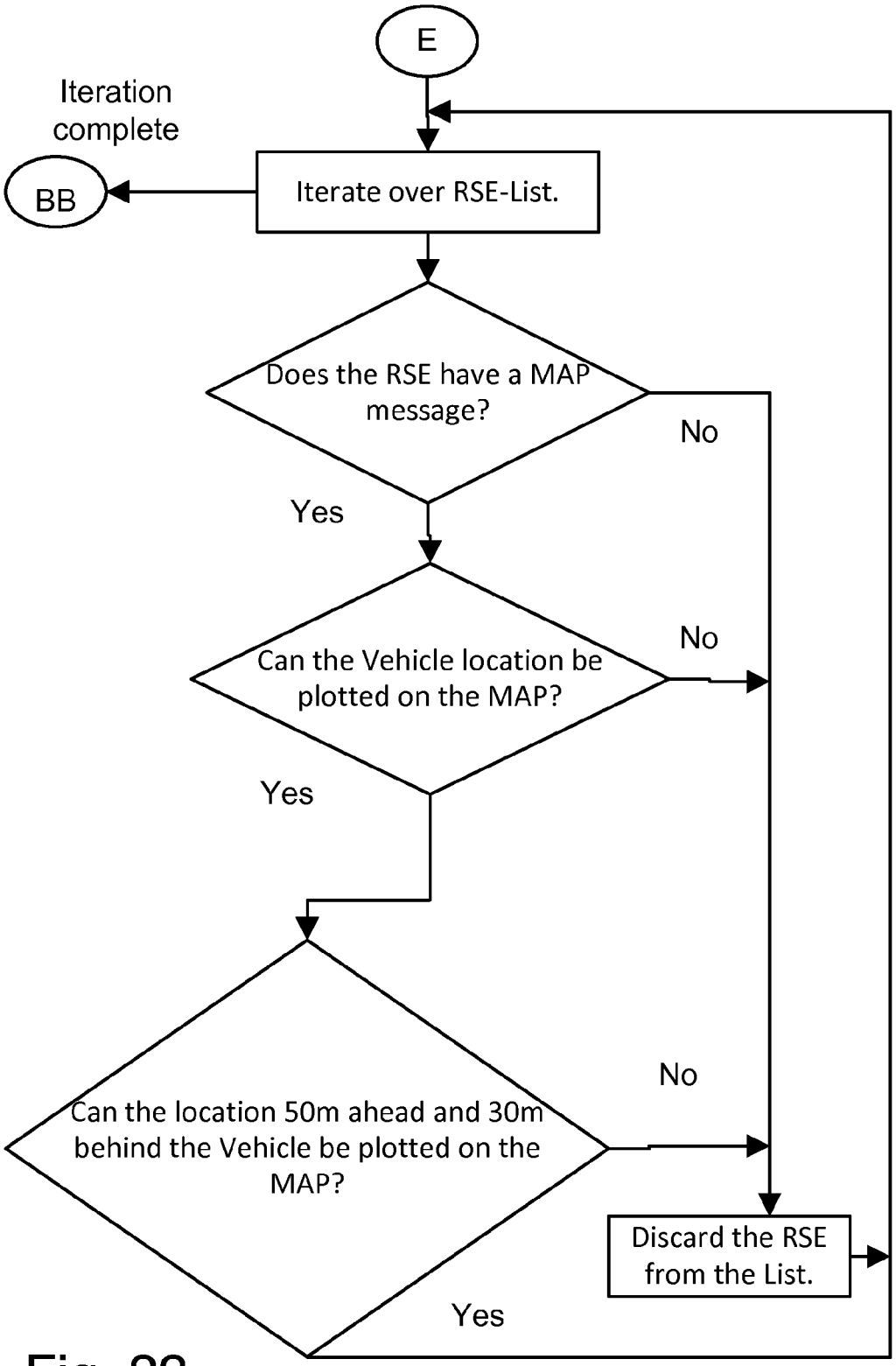
FIG. 22 is for one embodiment of the invention, for a method of RSE of interest selection for active safety applications.

We have the following steps: (see e.g. FIG. 22)

Figure 24:
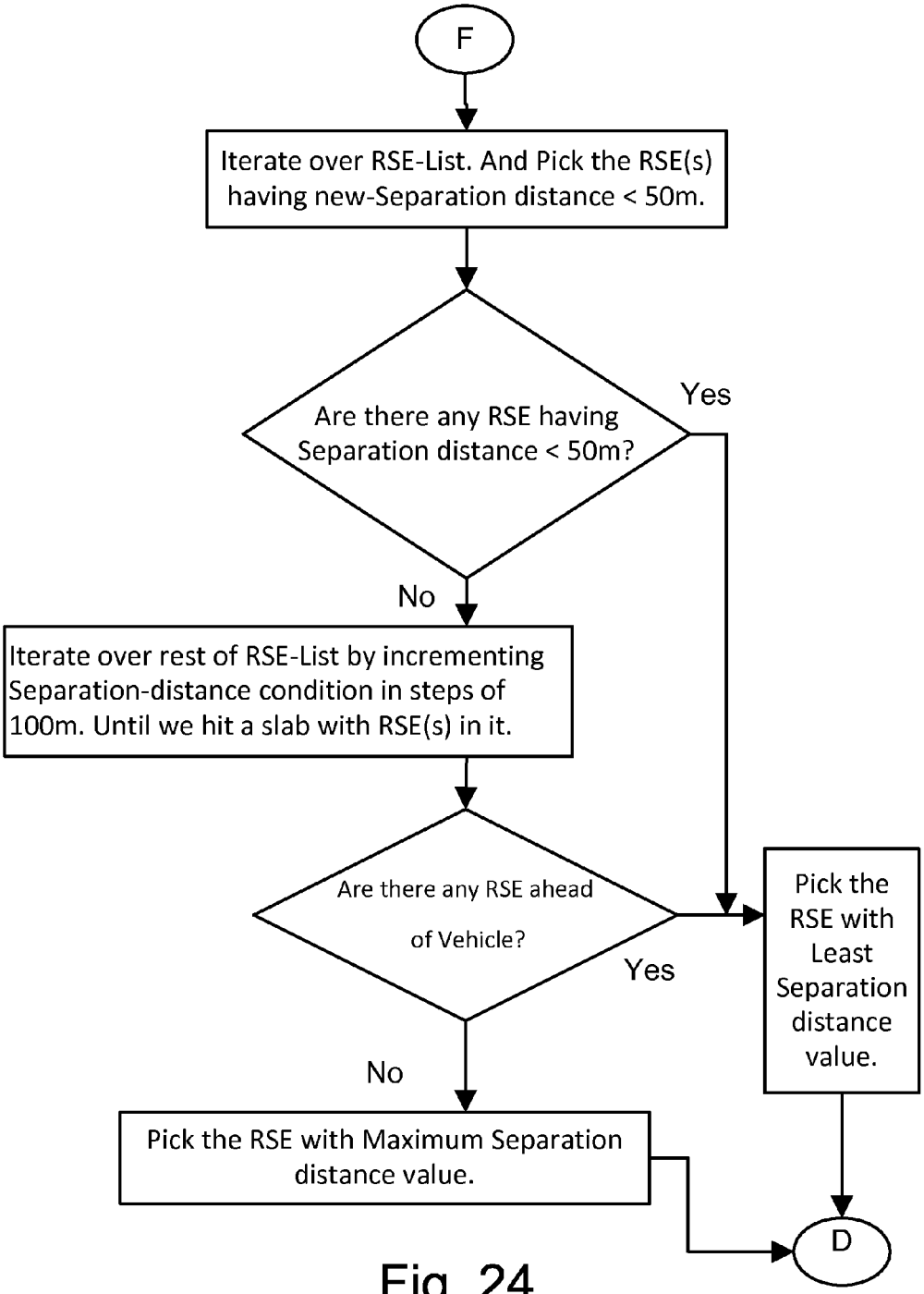
FIG. 24 is for one embodiment of the invention, for a method of RSE of interest selection for active safety applications.

1—First of all, Validate the MAP-message, to check the MAP can be used for this step or not.
Of all MAPs, discard the MAPs (and the corresponding RSE) on which either the Vehicle cannot be plotted (lies within the map coverage), or if plotted, location of e.g. 50 m, or $d_7$, ahead of vehicle and/or e.g. 30 m, or $d_5$, behind of the vehicle cannot be plotted.
In case a generic MAP is present, use it. Otherwise, pick up the MAP message which can plot the maximum number of the available (given) RSEs.
Of all these MAPs, select the MAP from the RSE which has the least separation distance ($L_1$) from the Vehicle. (see e.g. FIG. 24) (Use a formula similar to the Range L formula, in Section 1,"RSE Filtering", shown above.)

2—Discard all the RSE(s) which cannot be plotted using the selected MAP message.

3—Determine whether there are any RSE(s) located near Point-of-Interest (POI) (determined in Step-3, based on Remote-Vehicle(s) location). If true, use these RSE attributes to filter other RSE(s):
Filter all RSE(s) having Down-Range greater than the Down-Range of RSE (POI).
Filter all RSE(s) having Separation distance ($L_2$) (based on MAP data) greater than the Separation distance of that of RSE (POI) ($L_3$). (or $L_2>L_3$)

4—Execute a simple Lane-Matching algorithm on the MAP message to determine the Lane-number on which the Vehicle is traversing. In one embodiment, the lane number is assigned from left to right, in a highway.

5—Determine the Lane-Properties of the Lane, and the Connecting Lanes for the current-Lanes based on the MAP-Message.

6—Based on Lane-Properties, determine if the Vehicle can head towards that RSE-Location, or not. If the Vehicle cannot proceed to an RSE-Location, Negate/Ignore that RSE from further processing.

Figure 23:
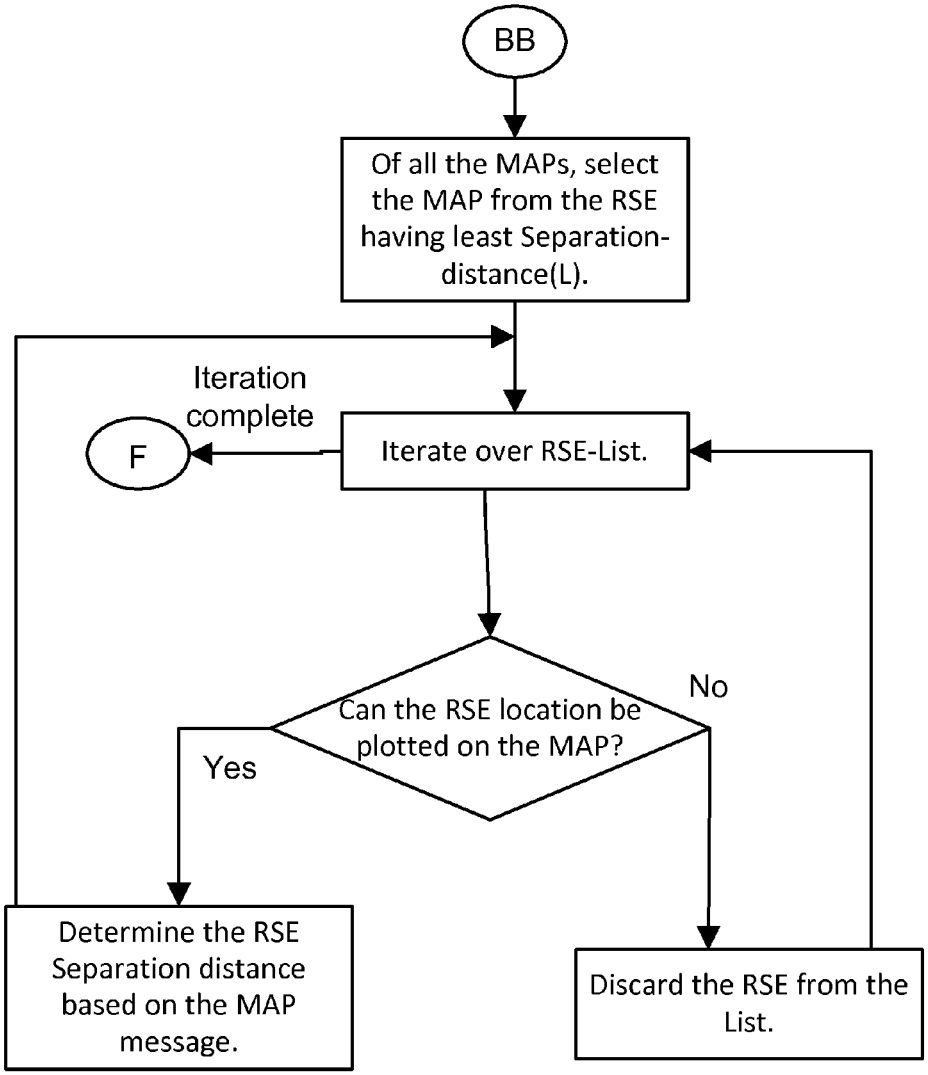
FIG. 23 is for one embodiment of the invention, for a method of RSE of interest selection for active safety applications.

7—Determine the RSE-Distance based on the MAP-message, from Vehicle-location to RSE-Location, traversing via the given MAP. (see e.g. FIG. 23)

8—Pick the RSE(s) which have a separation distance ($L_4$) of less than e.g. 100 m, or $d_4$. (or $d_4>L_4$)
Order the RSEs in Relevance list, in ascending order of Absolute-separation-distance of RSE from Vehicle.

9—For rest of the RSE(s), determine the number of Hops or steps each of the RSE requires to reach the RSE-Location from the current location of the Vehicle.
Hop-Number is determined based on number of RSE-locations the vehicle has to pass to reach a given location.

10—Order RSE(s) based on Hop-Numbers and Separation distances.
For all the RSE(s) having same Hop-number, order the RSE-based on the following parameters:
All RSE(s) which are ahead of the Vehicle, order the RSE(s) in ascending order of separation distance.
Next, for all RSE(s) which are behind of the Vehicle, order the RSE(s) in descending order of separation distance.
Order the RSE(s) in ascending order of Hop-numbers in the Relevance list.

6—Decide Which RSE to Use at the Present Instance.

In one embodiment, after ordering all the RSE(s), decide to either continue using existing RSE, or to switch to new RSE from the RSE-Relevance list. The decision is based on the Current RSE-location, RSE-Relevance list results, and Vehicle Location and its Dynamics.

1—Determine if the current RSE is still relevant, or we need to switch to a new RSE.
If the MAP of the RSE is present, check if the following conditions hold true. If any of the conditions break, release the Current RSE, and use new RSE from Relevance list.
MAP message from current RSE can be used to plot Vehicle location, and location-point e.g. 50 m, or $d_7$, ahead of vehicle and location points e.g. 30 m, or $d_5$, behind the vehicle.
Current RSE-Location is within e.g. 100 m, or $d_4$, of current Vehicle position.
Next RSE-Location (or intersection) is not within e.g. 100 m, or $d_4$, ahead of current vehicle position.
Determine location of Vehicle e.g. 3 or $T_{later}$ seconds later from current position, based on Vehicle dynamics, and Check if the new location can still be plotted inside the MAP-message of the current RSE. In one embodiment, $T_{later}$ is selected from the range of 1 to 10 sec.

If Map message is not present, check for the following conditions to be held true. If any of the conditions break, release current RSE, and use new RSE from the relevance list.

RSE separation distance is within e.g. 50 m, or $d_7$.

If current RSE is no more relevant, and the First RSE from the RSE-Relevance list is different from the Current RSE, do the following checks before picking a new RSE (Top RSE from the RSE-Relevance list).

Figure 25:
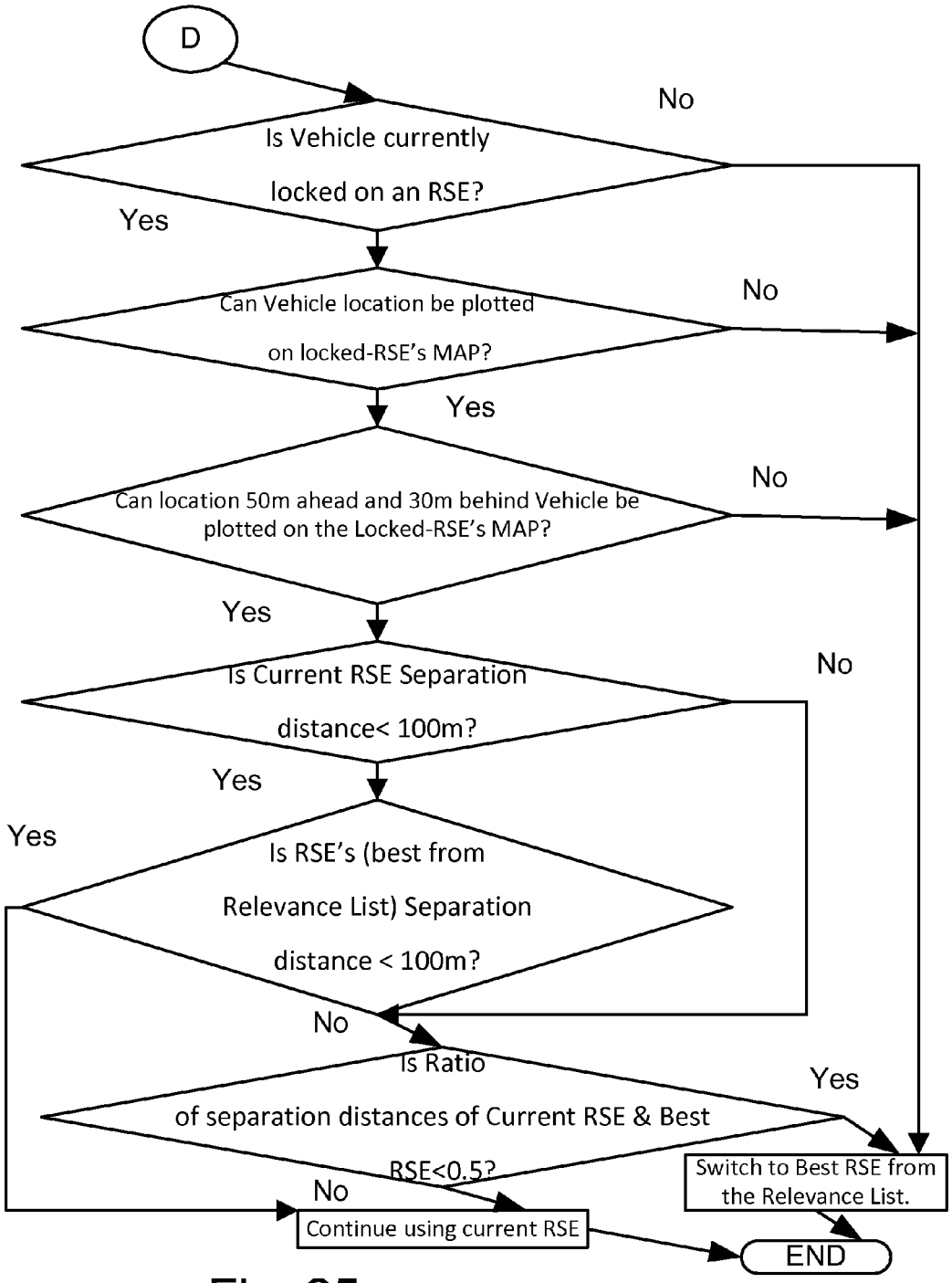
FIG. 25 is for one embodiment of the invention, for a method of RSE of interest selection for active safety applications.

Separation distance of new RSE is no more than twice (or the multiplication factor $F_{dist}$=2) the separation distance from current RSE. (If false, continue to hold on the current RSE.) (see e.g. FIG. 25) (In one embodiment, the multiplication factor $F_{dist}$ is selected from the range of 1 to 3, as a real number.)

In one embodiment, we do not have for the RSE of interest to download a security certificate. In one embodiment, for downloading the security certificate, the criteria must be to select the RSE that has the highest probability to stay the longest in OBU/RSE communication, i.e., probability of having the maximum communication time to insure that the OBU has enough communication time with the RSE to finish downloading the security certificate. This can be done by an intelligent cost function that takes into consideration the relative location of the RSE with respect to the vehicle, the vehicle dynamics, such as speed, the strength of the of the communication signal, the behavior (over time) of these data, and the other similar parameters.

For security purposes, in one embodiment, the communications between or to/from the RSE or vehicles or central computer or OBU or host vehicle or service provider or government agency are done with the encryption and/or certificates. In one embodiment, the private/public key infrastructure (PKI) is used, for authentication or verification. In one embodiment, a secret hash function produces a hash value, accompanying the message, which verifies the authenticity of the message, which both sides have a copy of, beforehand, which is stored in a safe module.

In one embodiment, if a communication unit or module or device has no certificate for authentication, the data from that unit is ignored. Or, no communication to that unit is performed. In one embodiment, the certificate has a digital signature or key from a known authority or trusted organization. In one embodiment, the certificate has different levels of security and reliability, e.g., for faster processing, depending on the situation. For example, for non-critical decisions (or local decisions, not affecting other vehicles), one can lower the thresholds for the level of security, for simpler authentication, and thus, faster processing time, or less delays (at the expense of the security, if/when the decision or data is non-critical for the outcome, or the outcome is non-critical).

In one embodiment, the certificate level of reliability gives different weights for the data obtained from that unit. In one embodiment, the certificate level of reliability gives different priorities for storing or processing data from various units. In one embodiment, the certificate level of reliability gives different order for ignoring the messages or data from different units.

In one embodiment, the certificate from emergency management agency or fire department or government agency has a priority on all other data and messages from other units of communication. These get the highest priority for processing, and they cannot be discarded. For example, for flood news, accident pile up at the interstate highway, or tornado at some region, affecting the traffic, coming from the local or Federal government agencies, get the highest message or data processing priorities, before any other data, for emergency and safety reasons. The emergency code (e.g. code red for the highest level of emergency) is also encoded and carried e.g. in or with the message, or within its header or packaged data. Like any other message or data, in one example, the message should first be authenticated, before any action on the message takes place.

In one embodiment, there is a redundancy on the part of the units, e.g., to make sure if one or more units are disabled or attacked by hackers or have technical problems to properly function, then the others can collectively do the job, and bring enough information and data to make a right decision at the end. So, in one embodiment, there is an overlap in the coverage area, intentionally, in the circle or sphere of coverage, for the neighboring units, at a higher cost for overall infrastructure, but safer and more reliable for the outcome, at times of emergency and disaster, when not all units are functional. In one embodiment, there is a redundancy for verification of data, to make sure, e.g., one unit is not hacked, by checking it against others, as a predictive or extrapolating or self-checking mechanism, to find or pinpoint the unreliable unit, e.g., when the unit is consistently giving out wrong data, or inconsistent information, compared with all other units around it.

Figure 26:
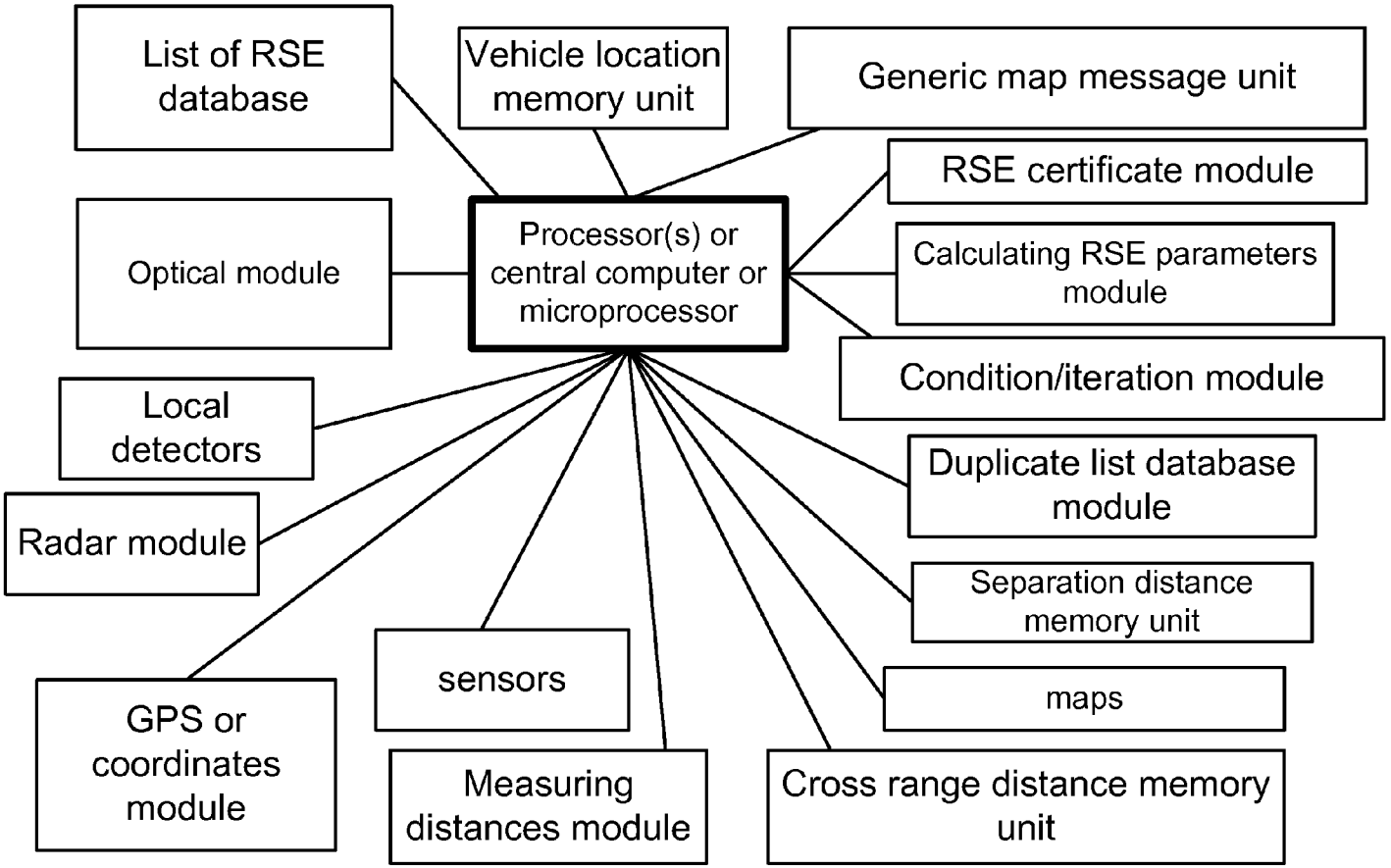
FIG. 26 is for one embodiment of the invention, for a system of RSE of interest selection for active safety applications.
Figure 27:
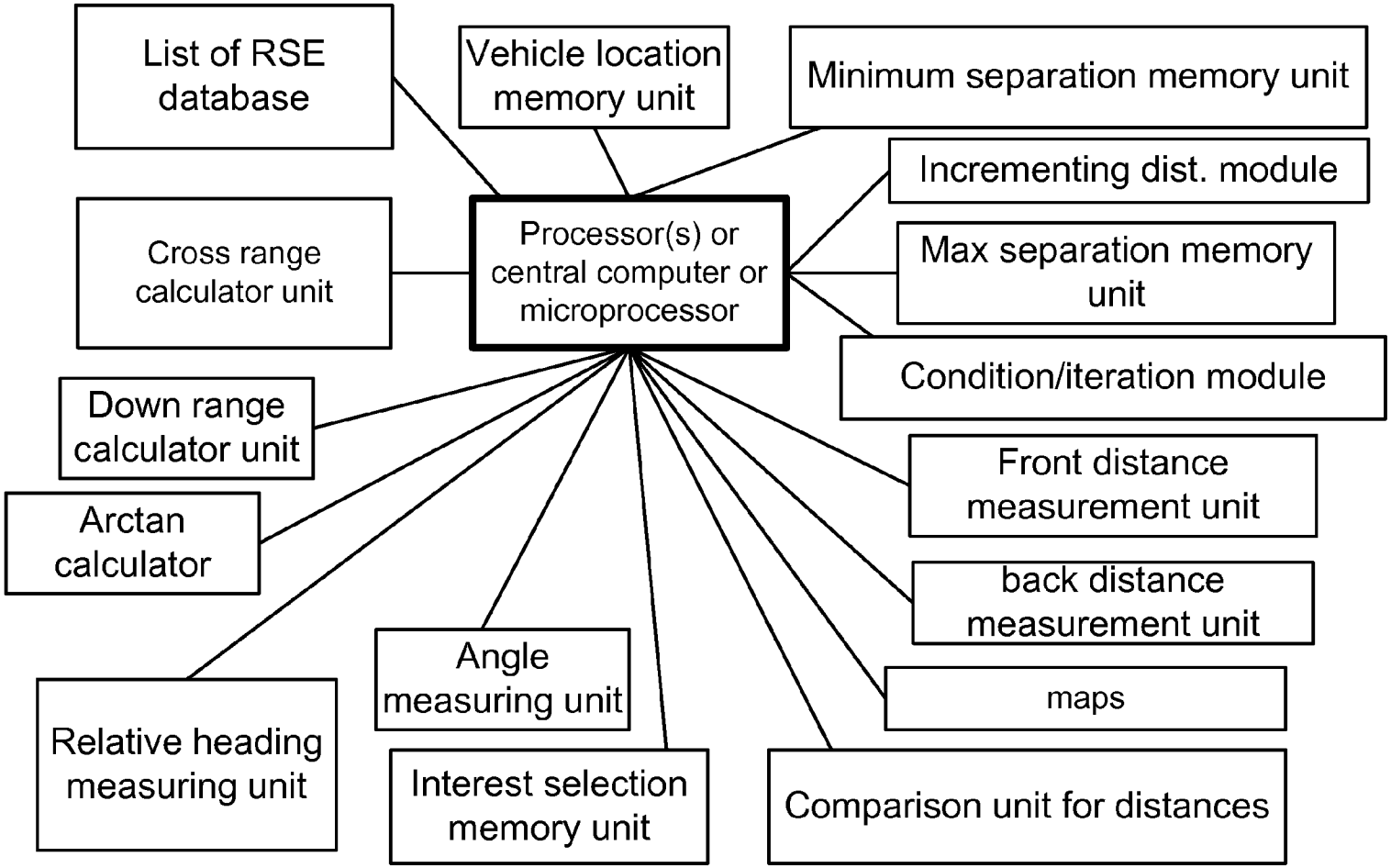
FIG. 27 is for one embodiment of the invention, for a system of RSE of interest selection for active safety applications.
Figure 28:
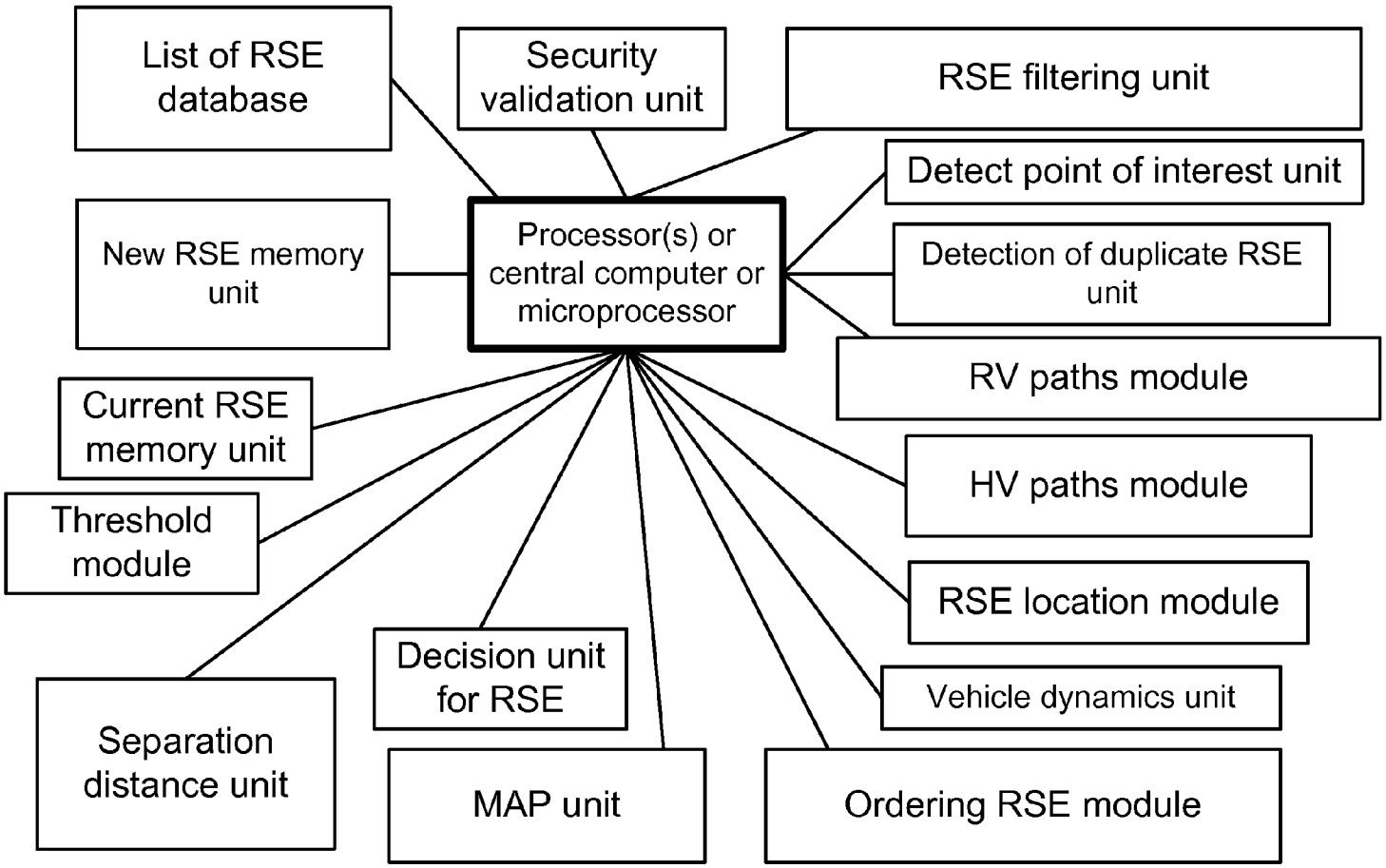
FIG. 28 is for one embodiment of the invention, for a system of RSE of interest selection for active safety applications.

FIGS. 18-25 are for embodiments of the invention, for method of RSE of interest selection for active safety applications. FIGS. 26-28 are for embodiments of the invention, for system of RSE of interest selection for active safety applications. FIG. 26 shows a system with a list of RSE database, with RSE certificate module, calculating distances with various methods and apparatuses. FIG. 27 shows a system with a loop or iteration module, measuring front and back distances, as well as down range and cross range, with corresponding angles. FIG. 28 shows a system with a security validation device or module, with RSE filtering and detecting duplicate RSEs, using RV and HV paths, as well as vehicle dynamics information or data.

Figure 29:
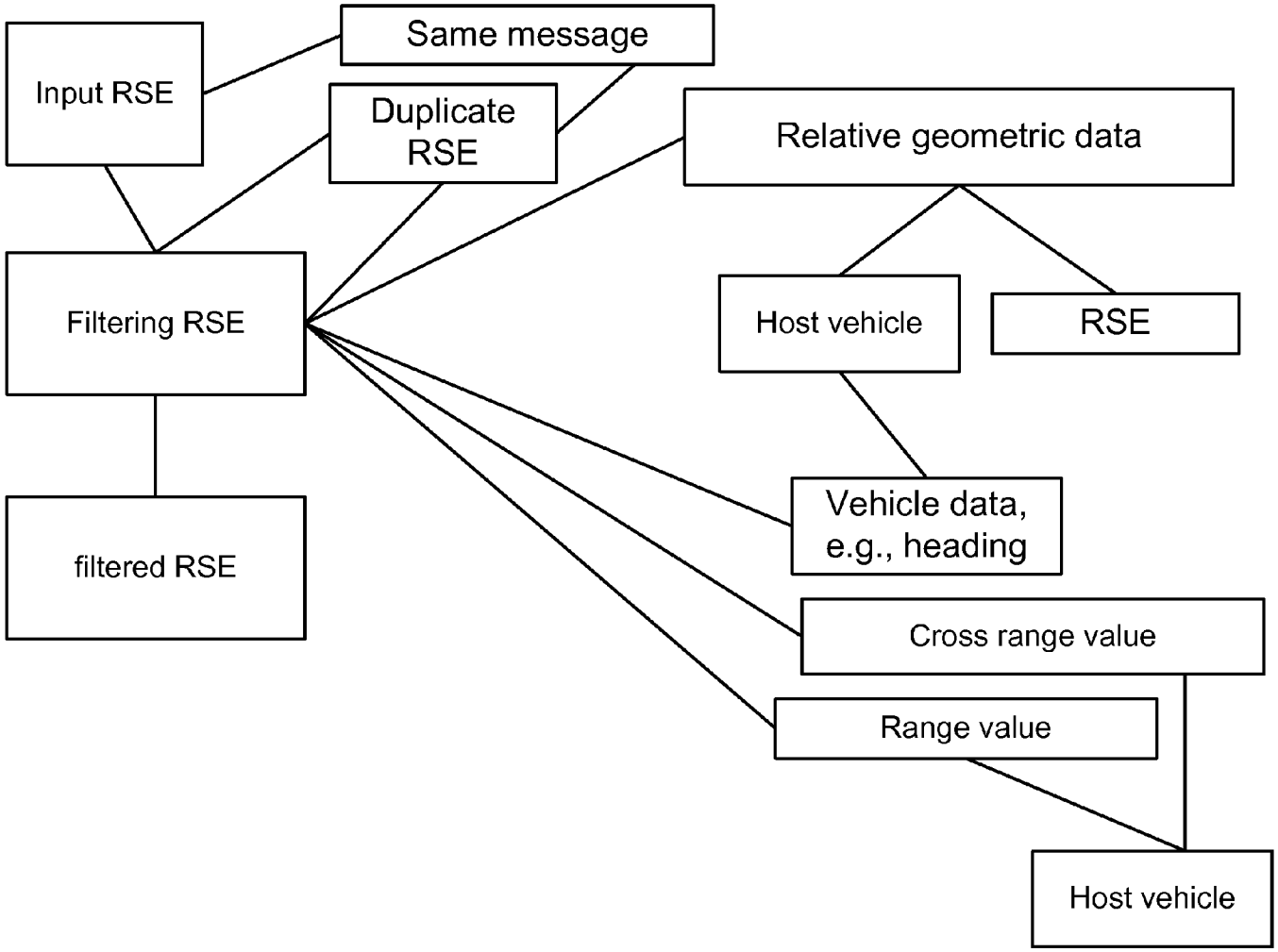
FIG. 29 is for one embodiment of the invention, for a system of RSE filtering.
Figure 30:
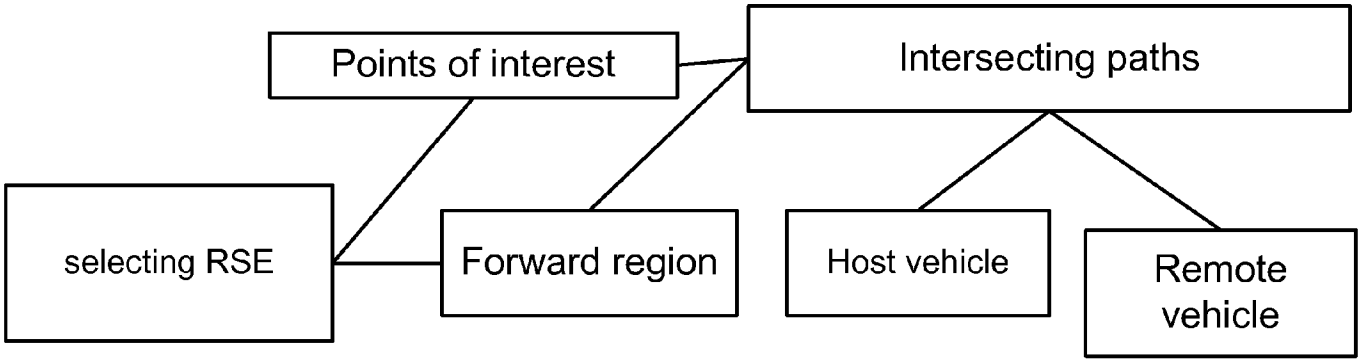
FIG. 30 is for one embodiment of the invention, for a system of detection of points of interest.
Figure 31:
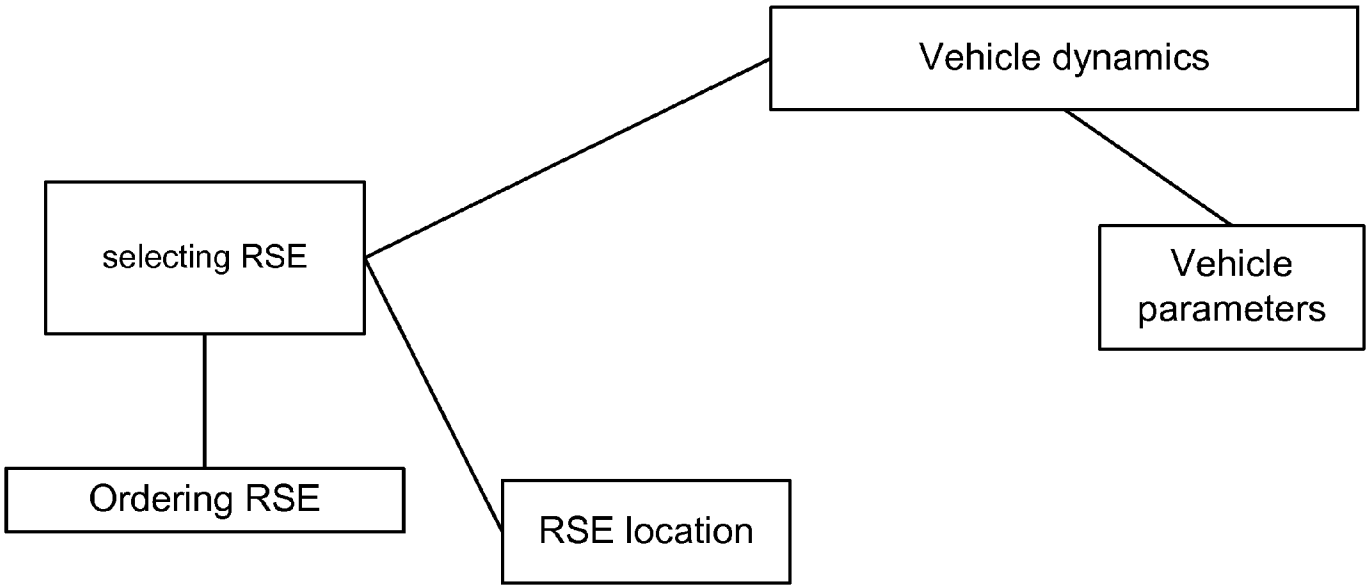
FIG. 31 is for one embodiment of the invention, for a system of ordering RSE.
Figure 32:
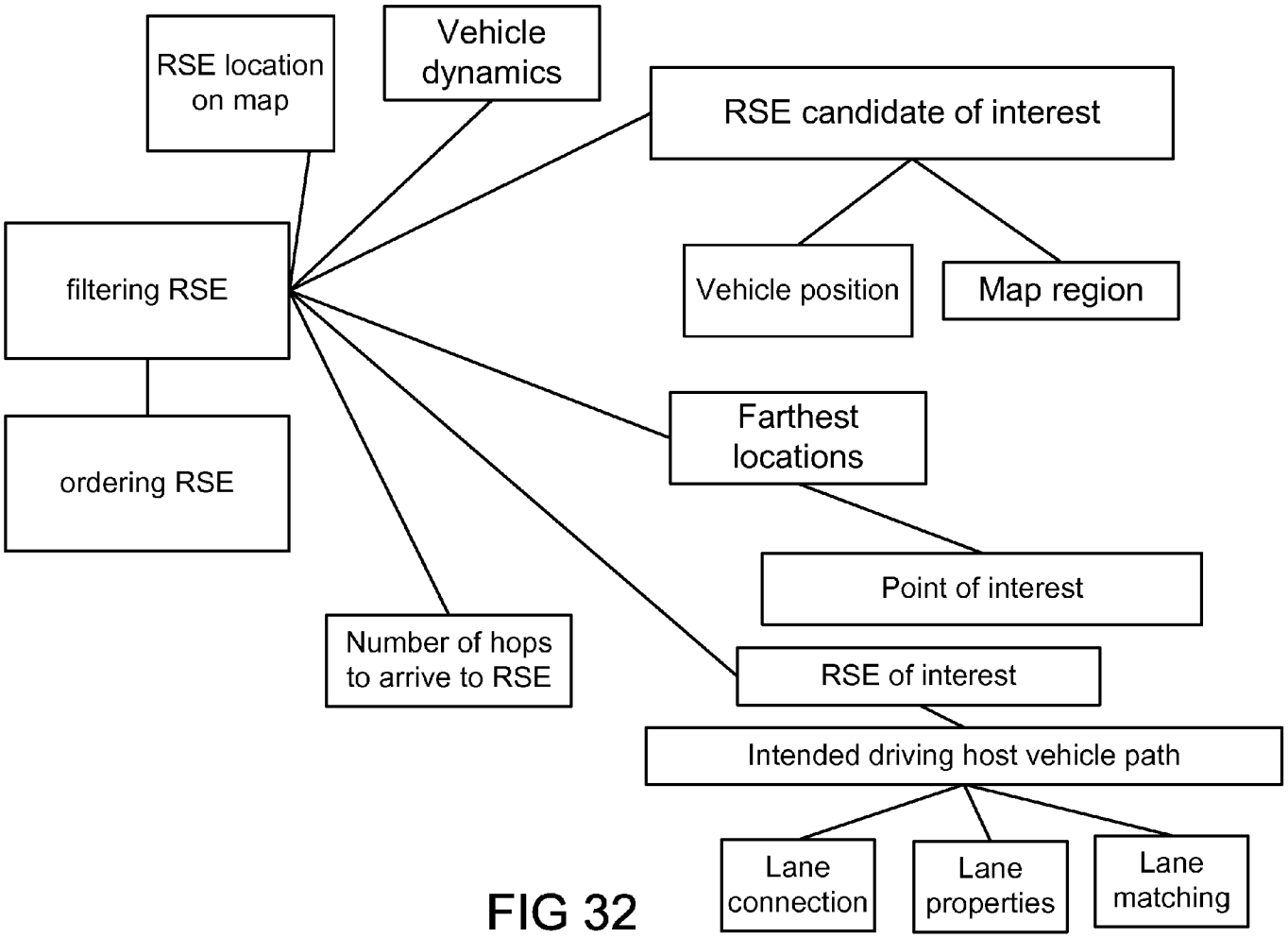
FIG. 32 is for one embodiment of the invention, for a system of ordering RSE based on RSE location on map and vehicle dynamics.
Figure 33:
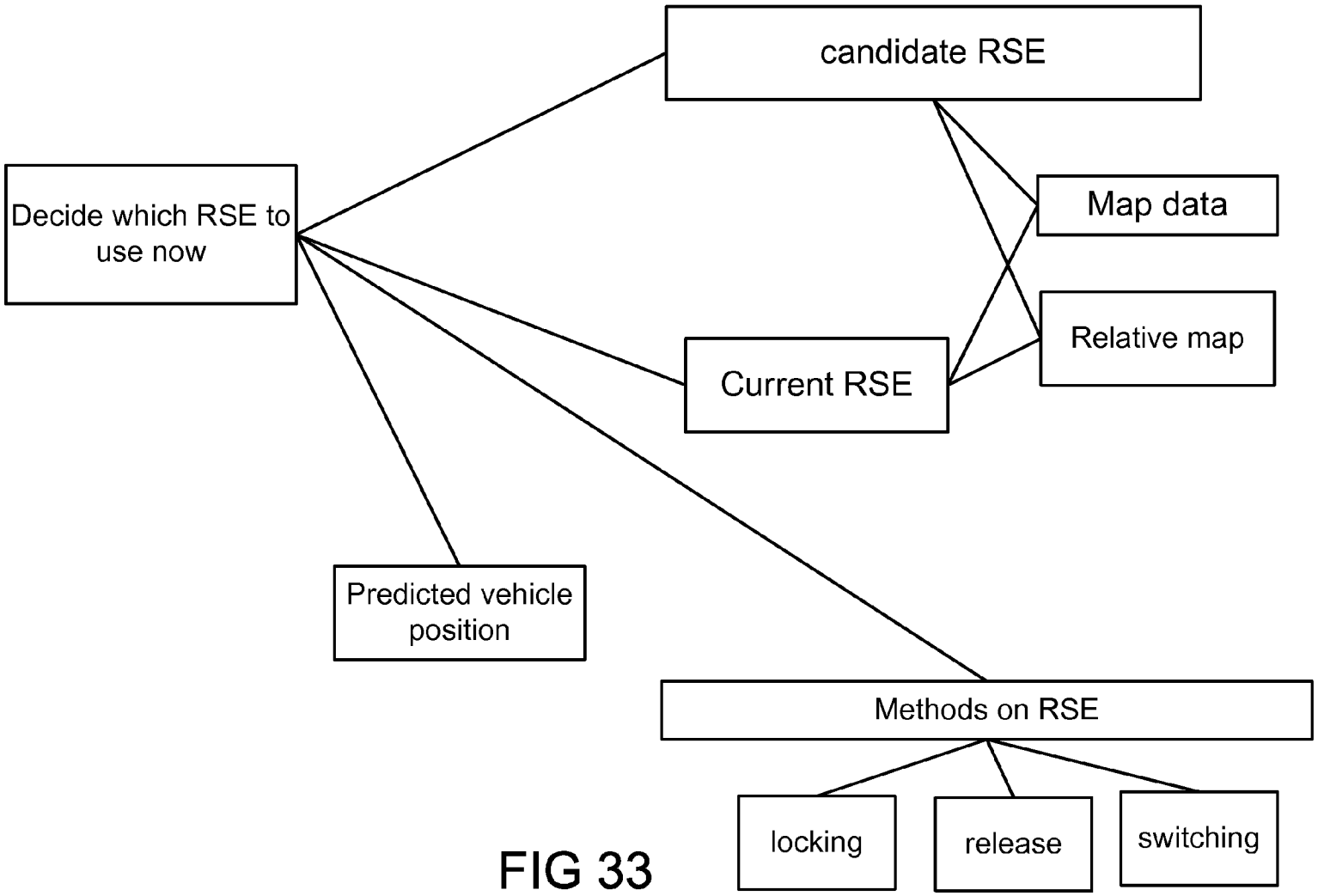
FIG. 33 is for one embodiment of the invention, for a system of deciding which RSE to use.
Figure 34:
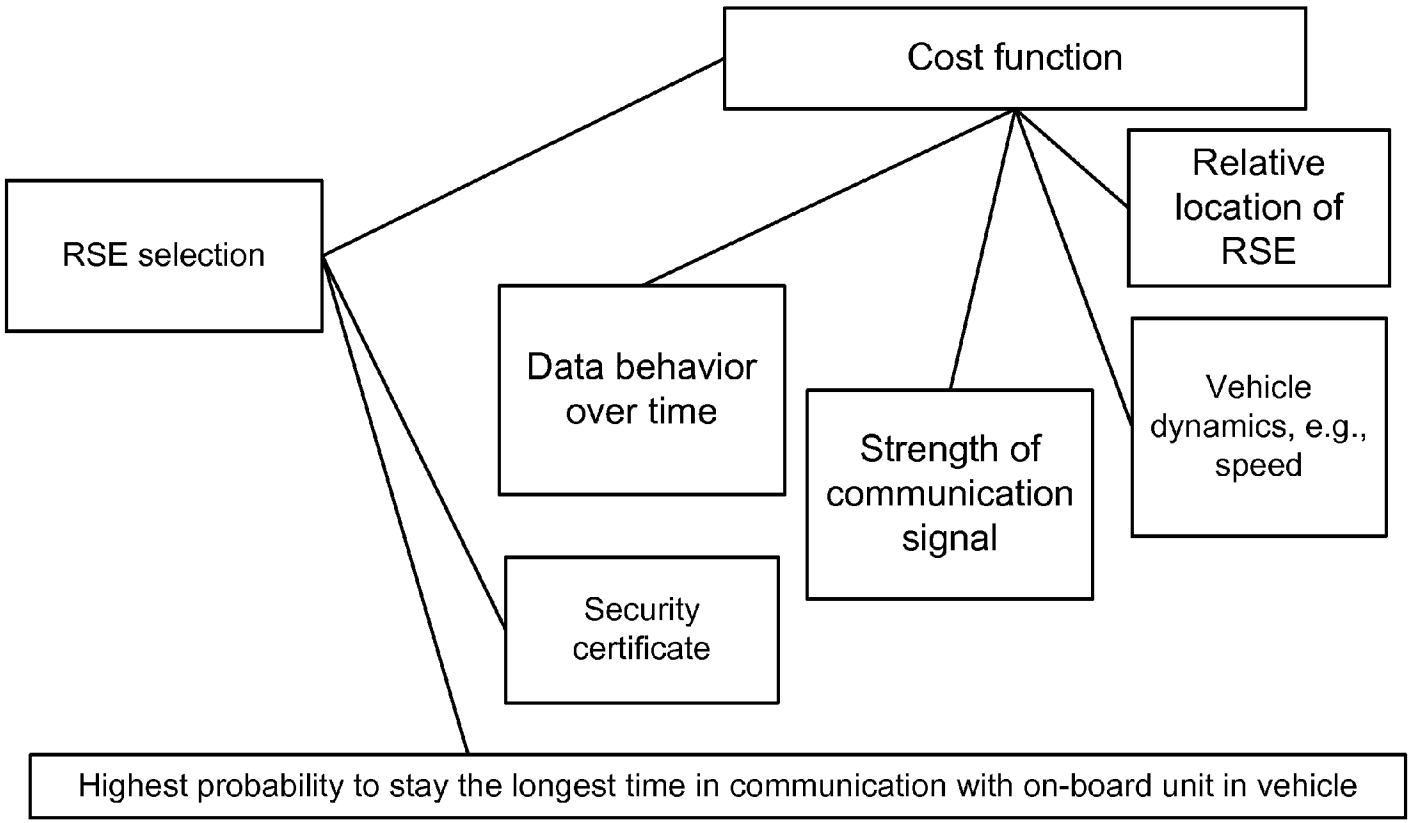
FIG. 34 is for one embodiment of the invention, for a system of selection of RSE based on security certificate.

FIG. 29 is for one embodiment of the invention, for a system of RSE filtering. FIG. 30 is for one embodiment of the invention, for a system of detection of points of interest. FIG. 31 is for one embodiment of the invention, for a system of ordering RSE. FIG. 32 is for one embodiment of the invention, for a system of ordering RSE based on RSE location on map and vehicle dynamics. FIG. 33 is for one embodiment of the invention, for a system of deciding which RSE to use. FIG. 34 is for one embodiment of the invention, for a system of selection of RSE based on security certificate.

Here is one embodiment of the invention: A method for selecting road side equipment for controlling vehicles in a highway or street, said method comprising: a central computer receiving a total value which indicates number of road side equipment pieces that a host vehicle is able to receive data from; said central computer determining a type of data a first road side equipment piece transmits or supports; said central computer receiving a location of said first road side equipment piece from an input device; a certification device or module examining security validation of a certificate for said first road side equipment piece; said central computer receiving a location of said host vehicle; said central computer receiving dynamics information about said host vehicle; said central computer receiving a location of a second vehicle near said host vehicle from a location determination device or module; said central computer analyzing said total value which indicates number of road side equipment pieces that said host vehicle is able to receive data from, said type of data said first road side equipment piece transmits or supports, said location of said first road side equipment piece, said security validation of said certificate for said first road side equipment piece, said location of said host vehicle, said dynamics information about said host vehicle, and said location of said second vehicle near said host vehicle; and said central computer selecting said first road side equipment piece based on said analyzing step.

Here are more embodiments of the invention:

using relative geometric data.

anticipating said host vehicle's travel trajectory.

using said host vehicle's speed and direction.

releasing a lock on said first road side equipment piece.

transiting a lock to a second road side equipment piece.

incorporating a security validation factor.

filtering a second road side equipment piece.

determining a down-range value.

determining a cross-range value.

determining a front distance with respect to said host vehicle.

determining a back distance with respect to said host vehicle.

detecting a duplicate road side equipment piece.

detecting a point of interest.

determining an intersecting path for said host vehicle.

determining an intersecting path for said second vehicle.

ordering a second road side equipment piece, with respect to said first road side equipment piece.

using map data.

setting a threshold distance for back side direction of said host vehicle.

setting a threshold distance for front side direction of said host vehicle.

Here are more embodiments of the invention, for the system with various components:

RSE Filtering: (see FIG. 29)

RSE filtering is performed using derived relative geometric data between the host vehicle and the RSE's, in addition to the host vehicle data, such as heading.

RSE's are filtered using cross range value first, and then the range value measured from host vehicle.

Detect and Filter Duplicate RSE's: (see FIG. 29)

Detect RSE's which contain the same message.

After identifying duplicate RSE's, filter them iteratively based on range and cross range measured from the host vehicle.

Detection of Points of Interest (based on RV(s) and HV Intersecting Paths): (see FIG. 30)

Select the RSE's that is close to the forward region that results from intersecting the RV's path with the host vehicle path.

Ordering RSE Based on RSE-Location and Vehicle Dynamics: (see FIG. 31)

Fine select the RSE based on RSE location and vehicle dynamic data.

Ordering RSE Based on RSE-Location on MAP and Vehicle Dynamics: (see FIG. 32)

The RSE are filtered based on Map data and vehicle dynamic data.

The RSE candidate of interest can be considered if vehicle position is located well inside the received map region.

Filter RSE's that are located farthest from the defined Point of interest (defined above).

Determine RSE of interest based on intended driving host vehicle path, determined by lane matching, lane properties, and lane connection.

Filter using the number hops or steps to arrive to the RSE.

Decide Which RSE to Use at the Present Instance: (see FIG. 33)

Methods for locking, release, and switching the RSE.

Map data and relative map matched position, with respect to current RSE, and candidate RSE's, are used.

Predicted vehicle position is used.

Selection of RSE Based on Security Certificate Download: (see FIG. 34)

Select the RSE that has the highest probability to stay the longest time in communication with On-Board Unit (OBU in the vehicle), i.e., the one with the highest probability of having the maximum continuous communication time with the vehicle, to insure that the OBU has enough communication time with the RSE to finish downloading the security certificate.

This can be done using cost function that takes into consideration the relative location of the RSE with respect to the vehicle, the vehicle dynamics (such as speed), the strength of the communication signal, and the behavior of these data over time. The cost function can be based on rewards for the better results or penalties for the worse results. The cost function can be used e.g. in a loop, e.g. as a threshold to get out of the loop, after enough accuracy or improvement is achieved, or as a metrics for how close or how accurate the answer or result is at this stage, or if there is enough incentive to continue on improving at this point (or we should stop at this point, with the current result).

Figure 1:
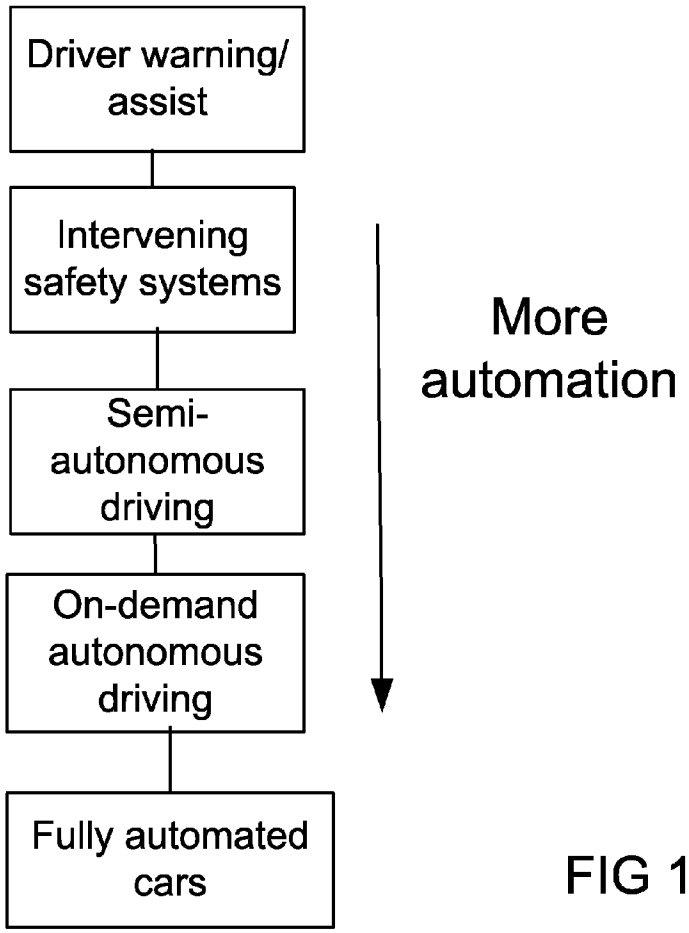
FIG. 1 is for one embodiment, as an example, for representation of development of fully automated vehicles, in stages.
Figure 2:
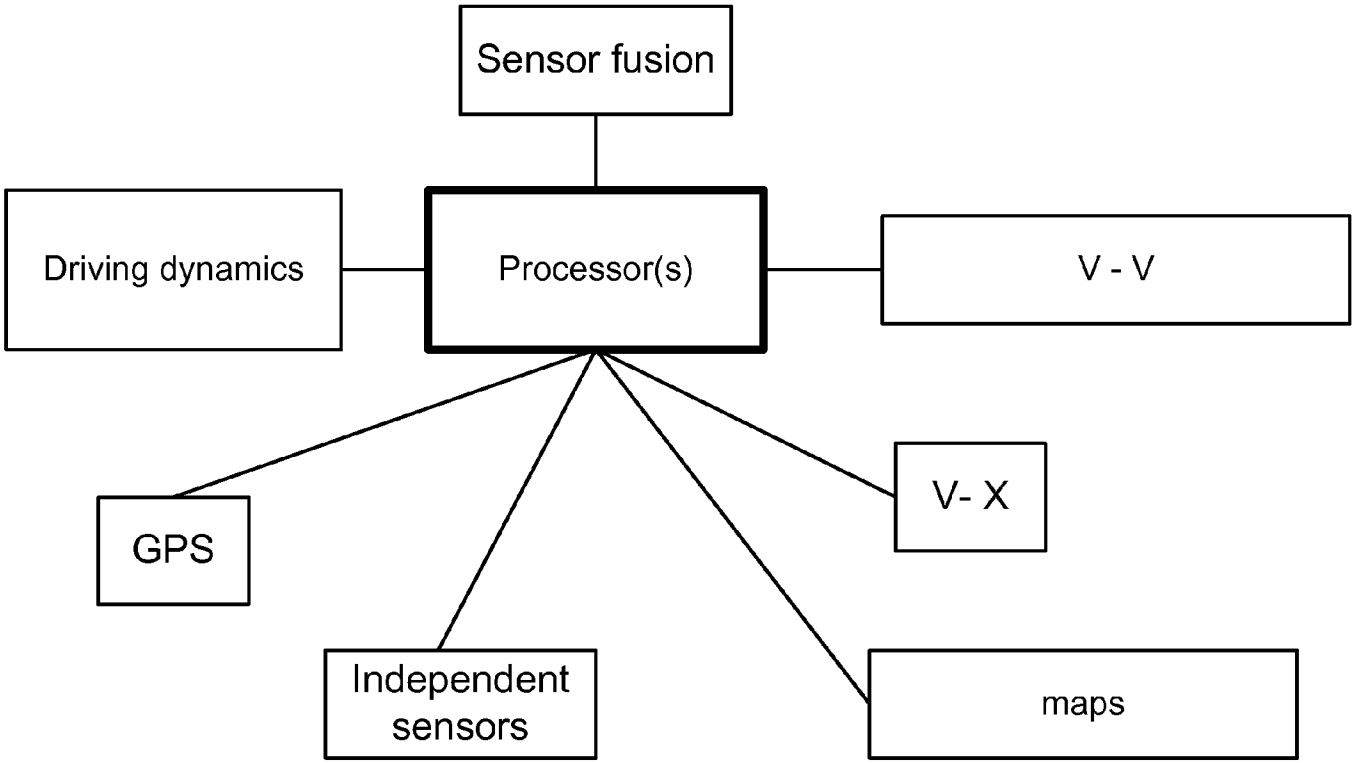
FIG. 2 is for one embodiment of the invention, for a system for automated vehicles.

Description of the Overall System:

Here, we describe the general/overall system for our embodiments above. FIGS. 1-9 describe in details the presented automated vehicle system. FIGS. 10-17 explain some embodiments of the current invention. FIG. 1 is for one embodiment, as an example, for representation of development of fully automated vehicles, in stages, for progression toward fully automated vehicles. FIG. 2 is for one embodiment of the invention, for a system for automated vehicles, using GPS, independent sensors, maps, driving dynamics, and sensor fusions and integrations.

Figure 3:
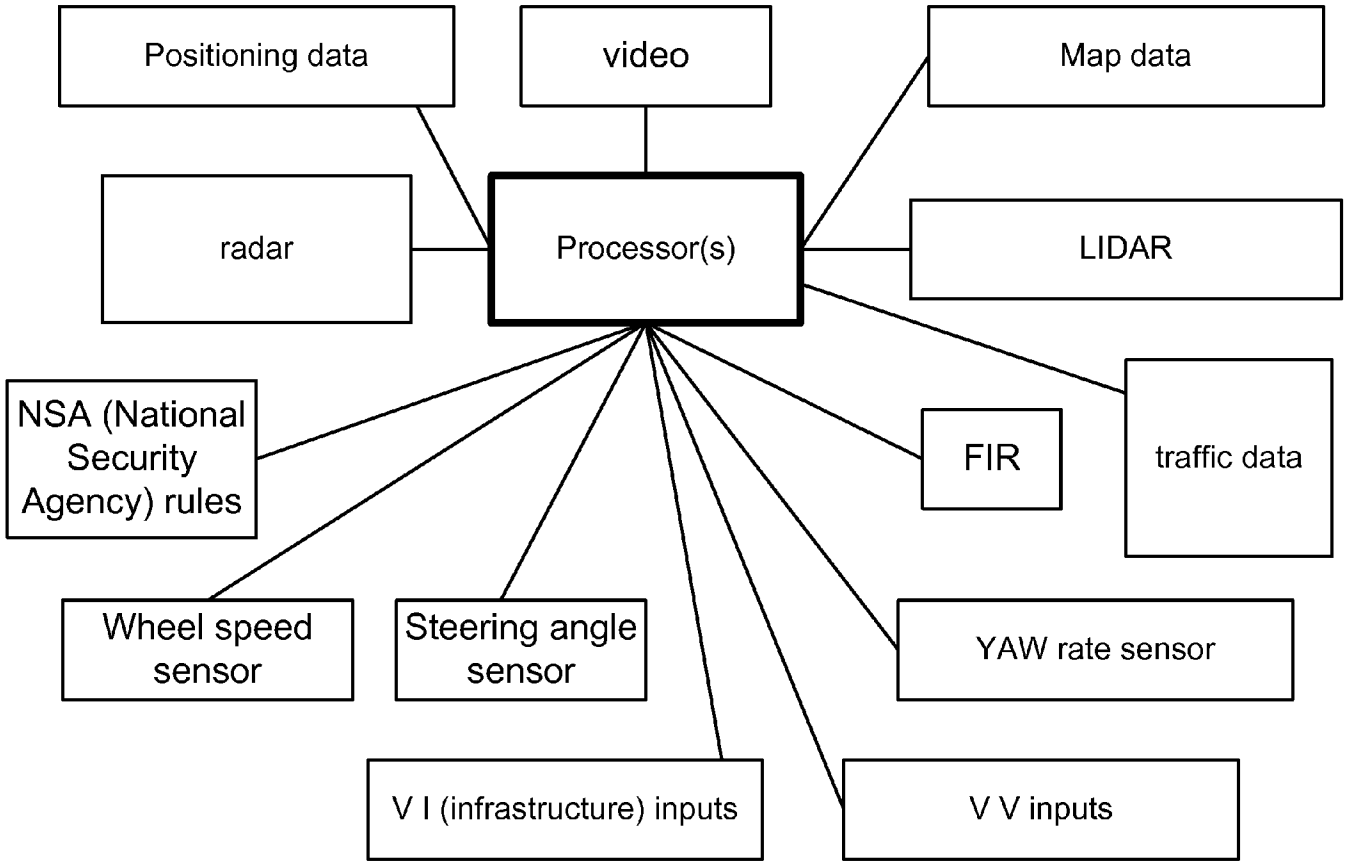
FIG. 3 is for one embodiment of the invention, for a system for automated vehicles.

FIG. 3 is for one embodiment of the invention, for a system for automated vehicles, with different measurement devices, e.g., LIDAR (using laser, scanner/optics, photodetectors/sensors, and GPS/position/navigation systems, for measuring the distances, based on travel time for light), radar, GPS, traffic data, sensors data, or video, to measure or find positions, coordinates, and distances. The government agencies may impose restrictions on security and encryption of the communications and data for modules and devices within the system, as the minimum requirements, as the hackers or terrorists may try to get into the system and control the vehicles for a destructive purpose. Thus, all of the components are based on those requirements imposed by the US or other foreign governments, to comply with the public safety.

Figure 4:
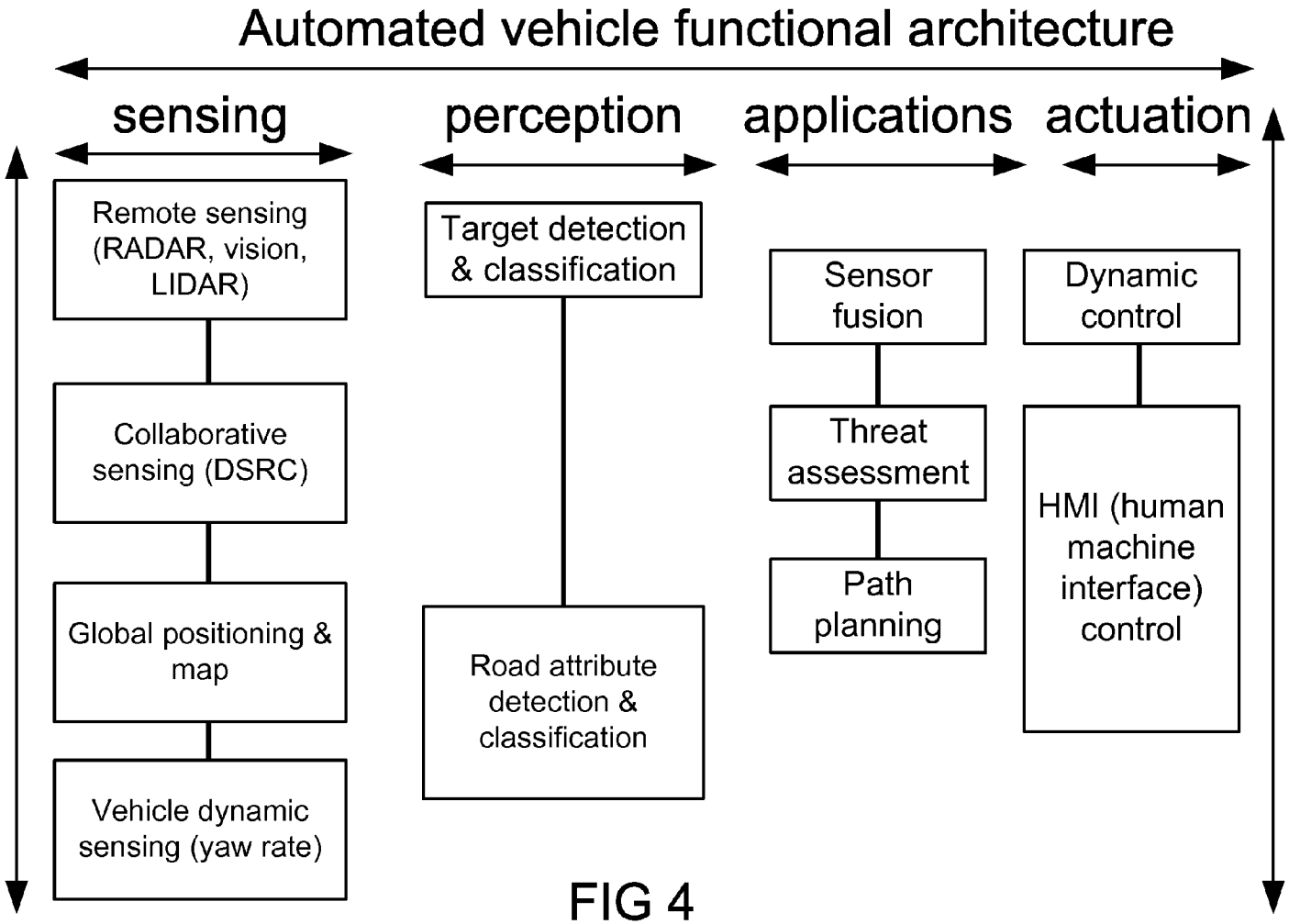
FIG. 4 is for one embodiment of the invention, for automated vehicle functional architecture.
Figure 5:
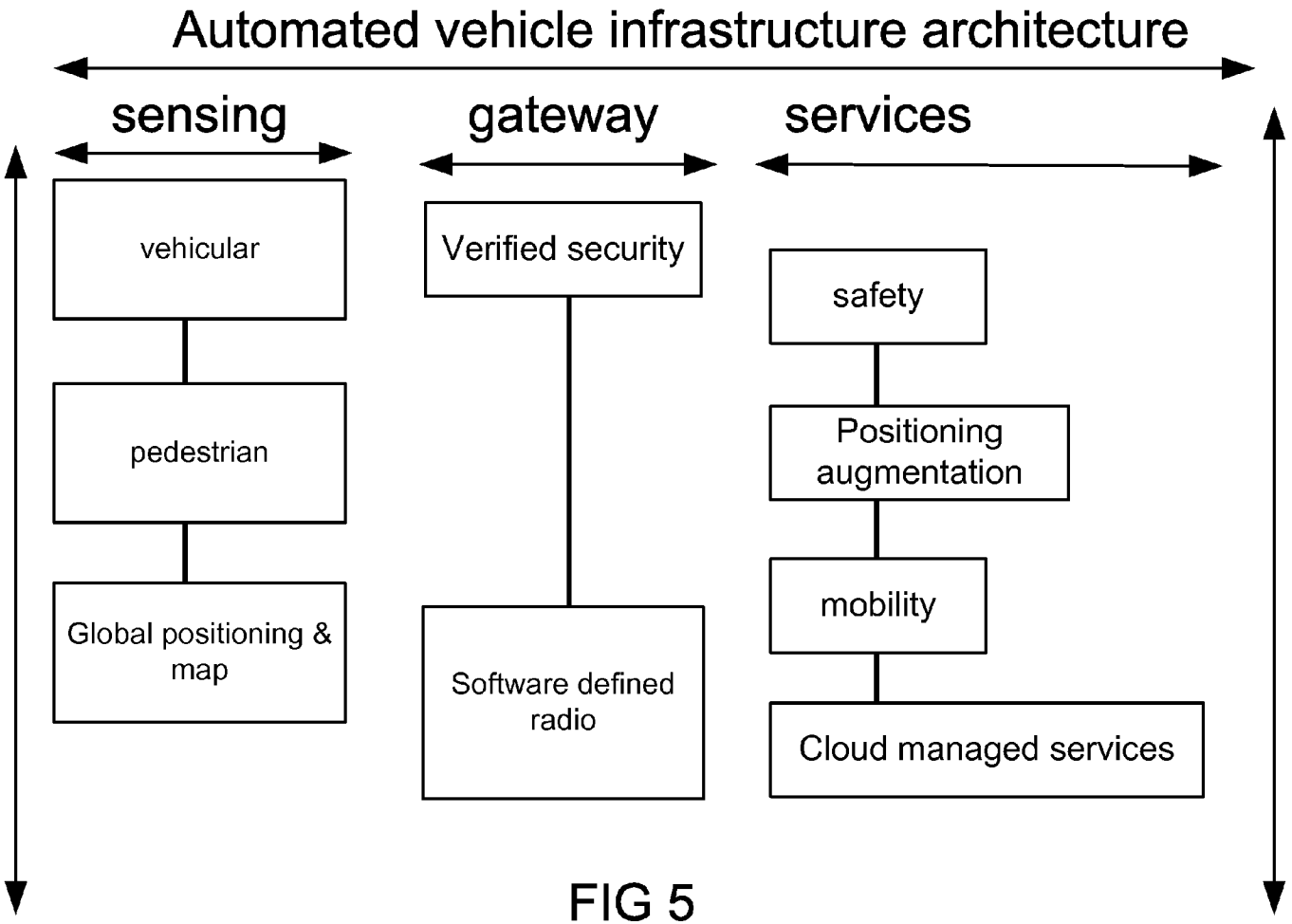
FIG. 5 is for one embodiment of the invention, for automated vehicle infrastructure architecture.

FIG. 4 is for one embodiment of the invention, for automated vehicle functional architecture, for sensing, perception, applications, and actuation. FIG. 5 is for one embodiment of the invention, for automated vehicle infrastructure architecture, for sensing, gateway, and services.

Figure 6:
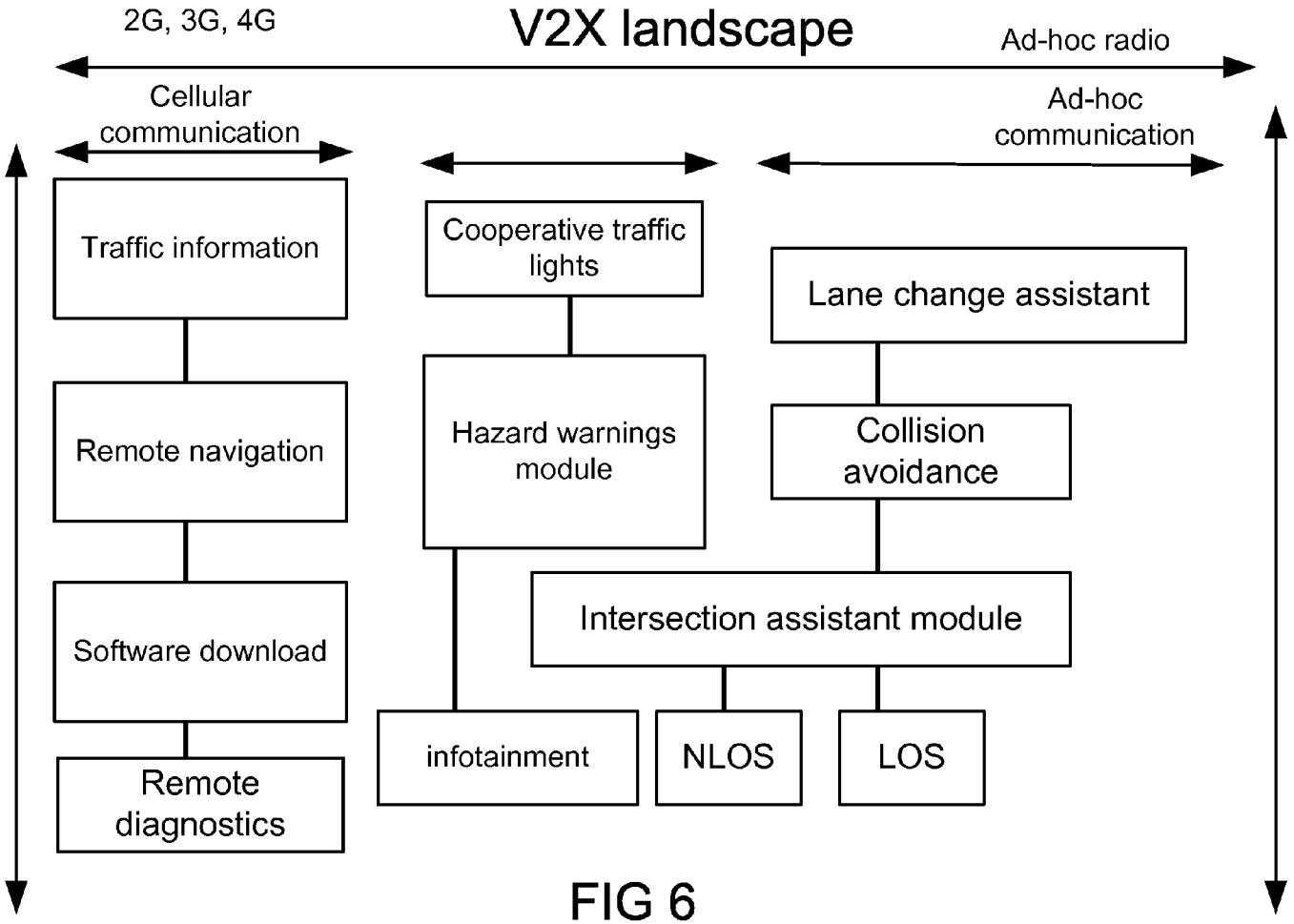
FIG. 6 is for one embodiment of the invention, for a system for V2X landscape, with components.
Figure 7:
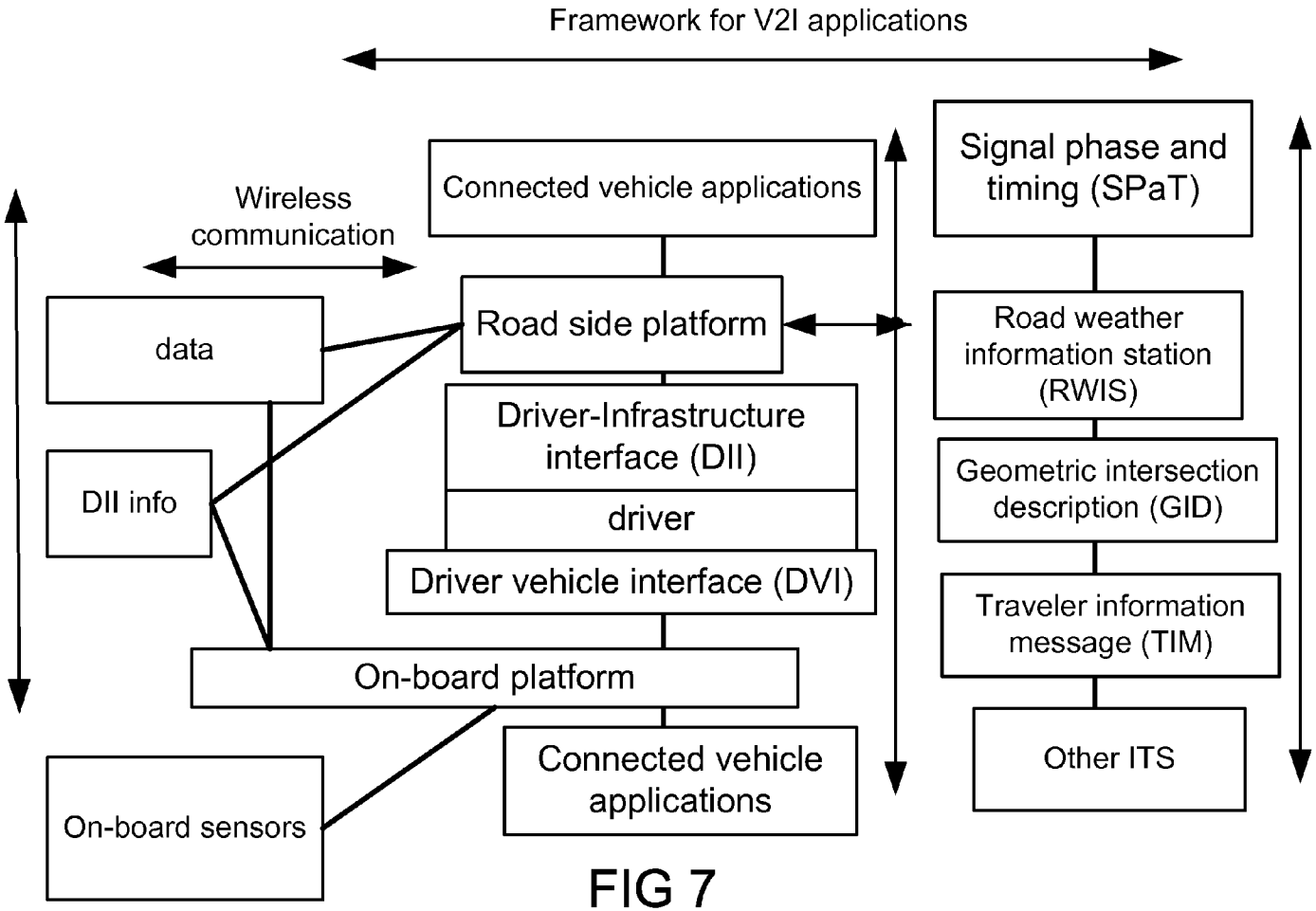
FIG. 7 is for one embodiment of the invention, for a system for framework for V2I applications, with components.

FIG. 6 is for one embodiment of the invention, for a system for V2X landscape, with components, for spectrum and range of frequencies and communications, for various technologies, for various purposes, for different ranges. FIG. 7 is for one embodiment of the invention, for a system for framework for V2I applications, with components, for road-side platform and on-board platform, using various messages and sensors.

Figure 8:
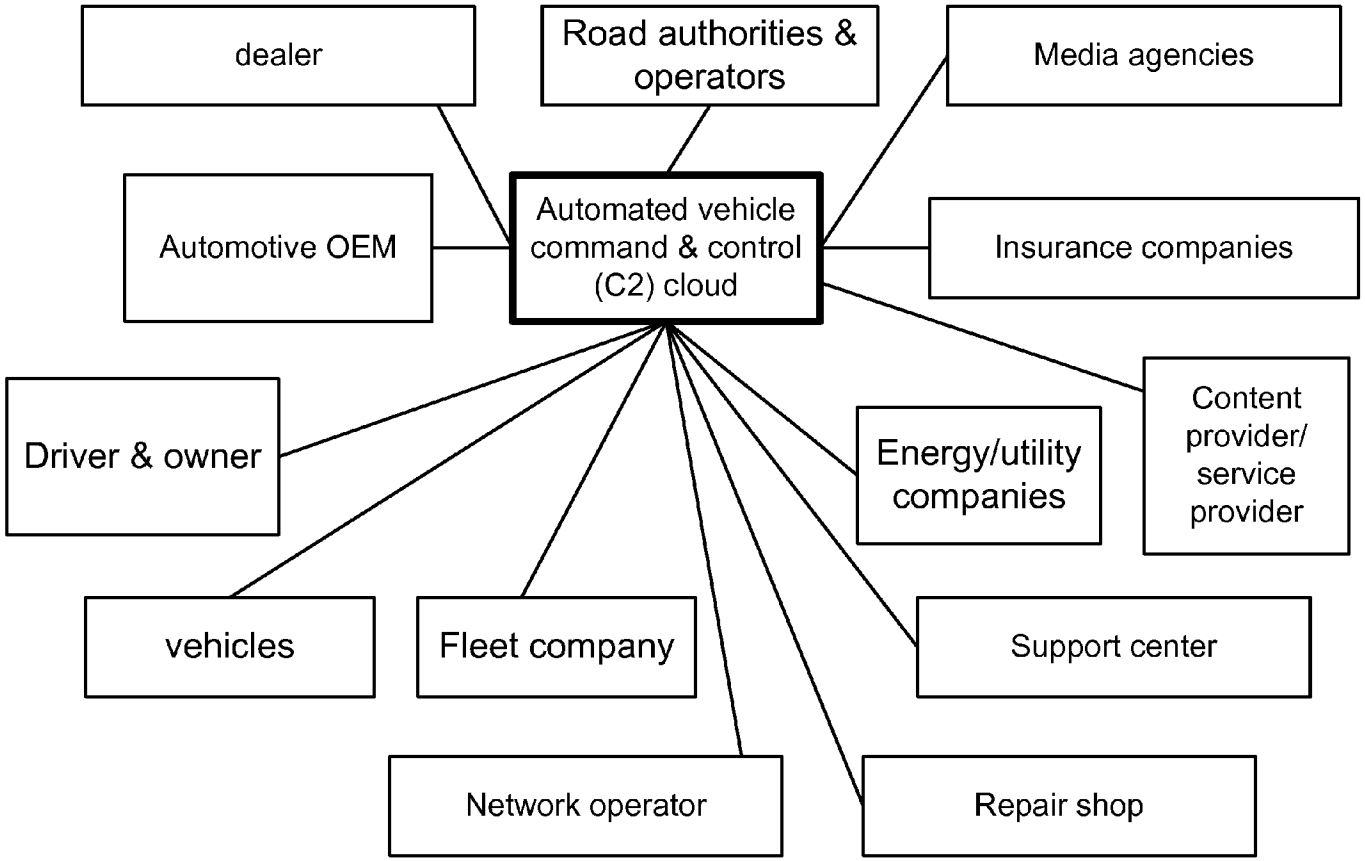
FIG. 8 is for one embodiment of the invention, for a system for automated vehicle command and control (C2) cloud, with components.
Figure 9:
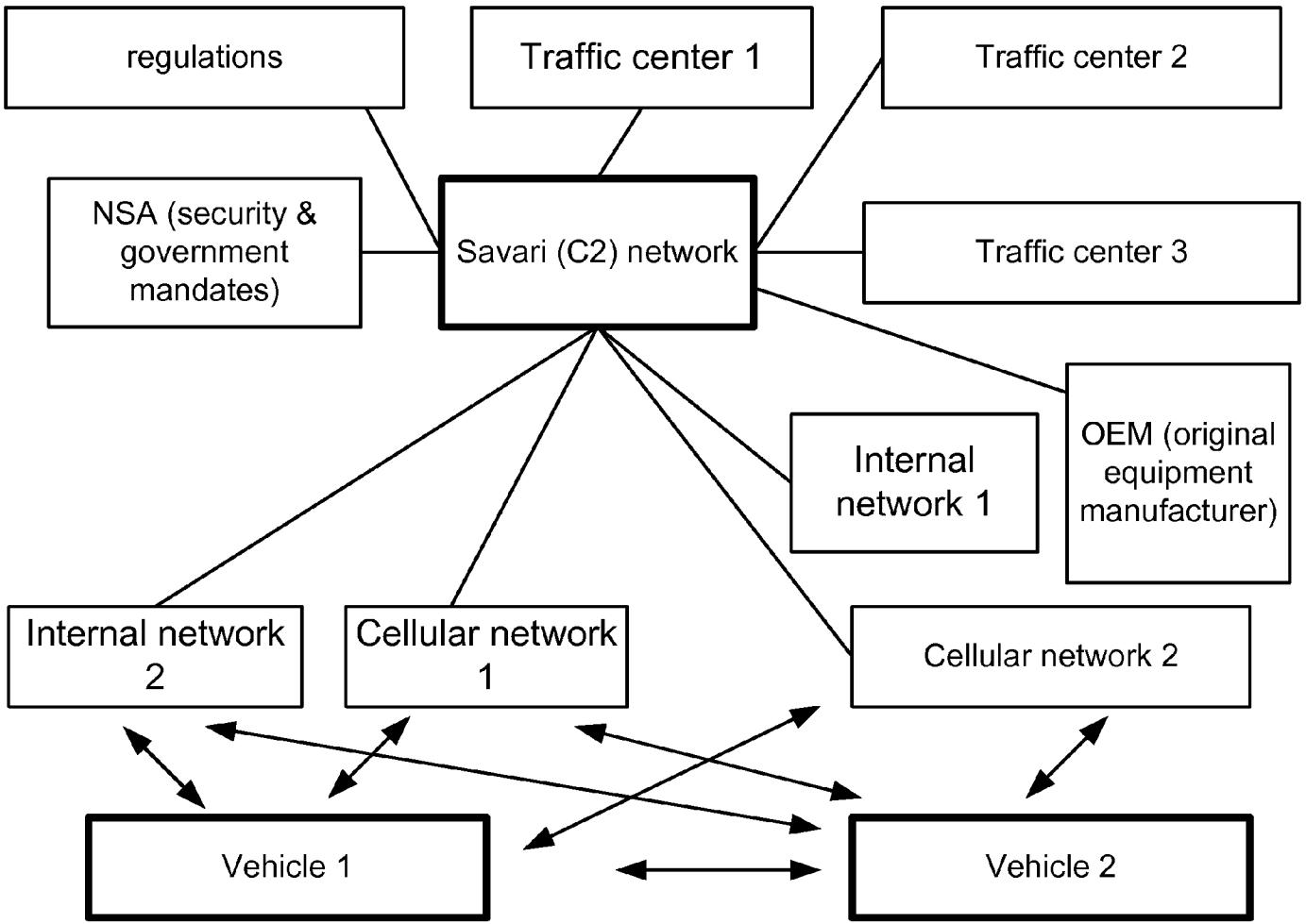
FIG. 9 is for one embodiment of the invention, for a system for our (Savari) C2 network, with components, showing communications between networks and vehicles.

FIG. 8 is for one embodiment of the invention, for a system for automated vehicle command and control (C2) cloud, with components, with various groups and people involved, as user, beneficiary, or administrator. FIG. 9 is for one embodiment of the invention, for a system for our (Savari) C2 network, with components, showing communications between networks and vehicles, using traffic centers' data and regulations by different government agencies.

In one embodiment, we have the following technical components for the system: vehicle, roadway, communications, architecture, cybersecurity, safety reliability, human factors, and operations. In one embodiment, we have the following non-technical analysis for the system: public policy, market evolution, legal/liability, consumer acceptance, cost-benefit analysis, human factors, certification, and licensing.

In one embodiment, we have the following requirements for AV (automated vehicles) system:

- Secure reliable connection to the command and control center
- Built-in fail-safe mechanisms
- Knowledge of its position and map database information (micro and macro maps)
- Communication with traffic lights/road side infrastructure
- Fast, reliable, and secure
- Situational awareness to completely understand its immediate surrounding environment
- Requires multiple sensors
- Algorithms to analyze information from sensors
- Algorithms to control the car, for drive-by-wire capability In one embodiment, we have the following primary technologies for our system:

- V2X communication: time-critical and reliable, secure, cheap, and dedicated wireless spectrum
- Car OBE (on-board equipment): sensor integration (vision, radar and ADAS (advanced driver assistance system)), positioning (accurate position, path, local map), wireless module (physical layer (PHY), Media Access Control (MAC), antenna), security (multi-layer architecture), processing and message engine, and algorithms for vehicle prediction and control In one embodiment, we have the following building blocks for AVs:

- Automation Platform
  - i. Advanced Driver Assistance (ADAS) integration
  - ii. Map Integration, Lane Control
  - iii. Radio communications support
  - iv. Vehicle Controller Unit to do actuation
- Base Station
  - Ground positioning support to improve positioning accuracy
  - V2I (vehicle to infrastructure) functionality, support for public/private spectrums
  - Cloud connectivity to provide secure access to vehicles
- Command Control Center
  - i. Integration with Infrastructure Providers Here are some of the modules, components, or objects used or monitored in our system: V2V (vehicle to vehicle), GPS (Global Positioning System), V2I (vehicle to infrastructure), HV (host vehicle), RV (remote vehicle, other vehicle, or $3^{rd}$ party), and active and passive safety controls.

Figure 10:
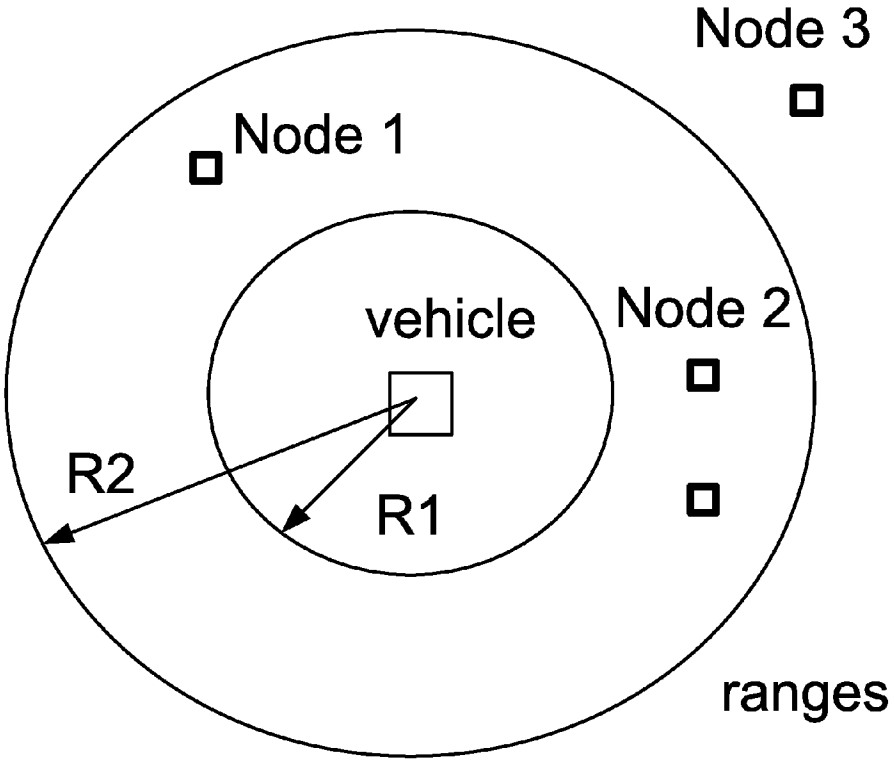
FIG. 10 is for one embodiment of the invention, for a system for host vehicle, range of R values, region(s) defined, multiple nodes or vehicles inside and outside region(s), for communications between networks and vehicles, and warning decisions or filtering purposes.
Figure 11:
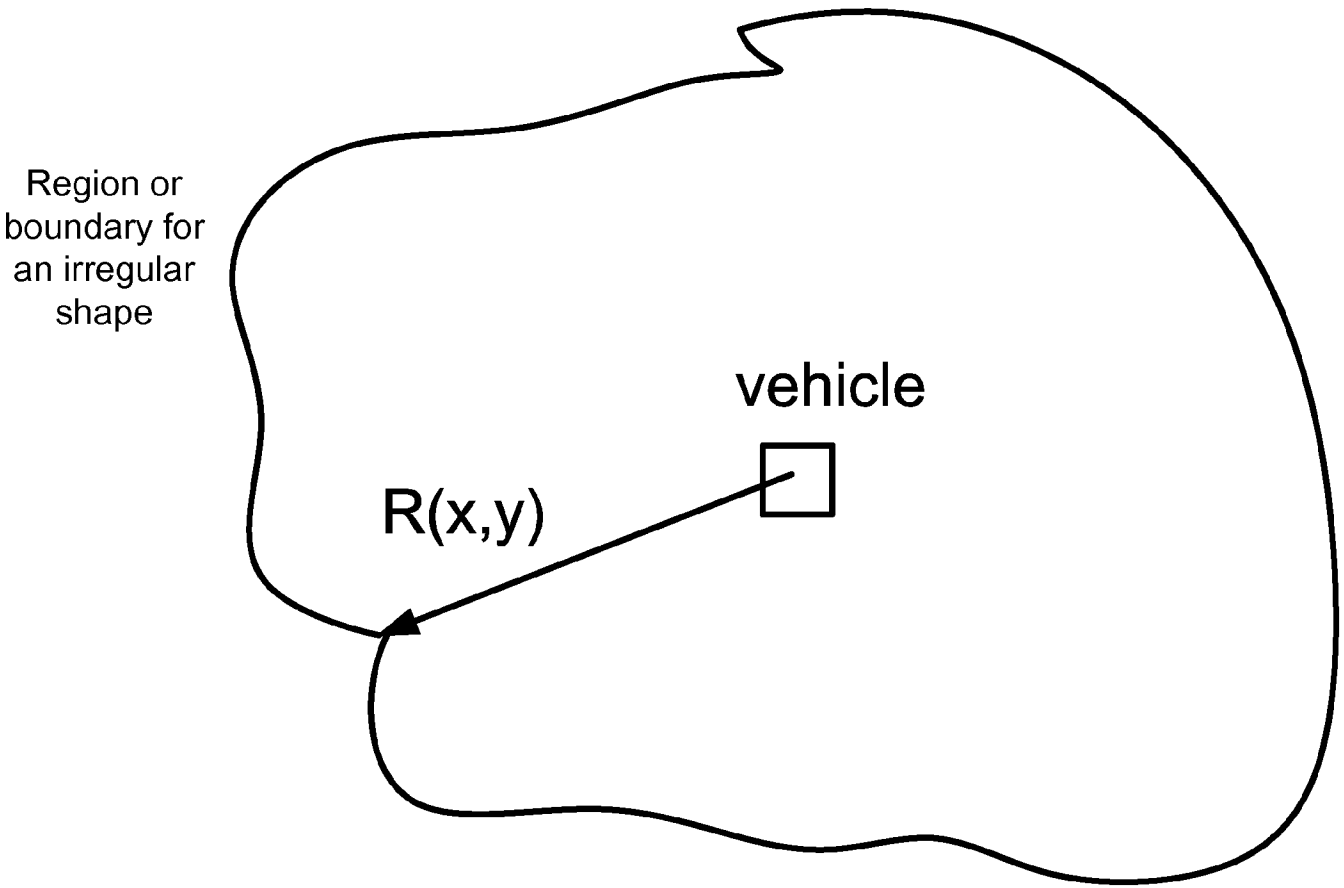
FIG. 11 is for one embodiment of the invention, for a system for host vehicle, range of R values, region(s) defined, for an irregular shape(s), depending on (x,y) coordinates in 2D (dimensional) coordinates, defining the boundaries.

FIG. 10 is for one embodiment of the invention, for a system for host vehicle, range of R values, region(s) defined, multiple nodes or vehicles inside and outside region(s), for communications between networks and vehicles, and warning decisions or filtering purposes, for various filters to reduce computations and reduce the bandwidth needed to handle the message traffic. FIG. 11 is for one embodiment of the invention, for a system for host vehicle, range of R values, region(s) defined, for an irregular shape(s), depending on (x,y) coordinates in 2D (dimensional) coordinates, defining the boundaries, or in 3D for crossing highways in different heights, if connecting.

Figure 12:
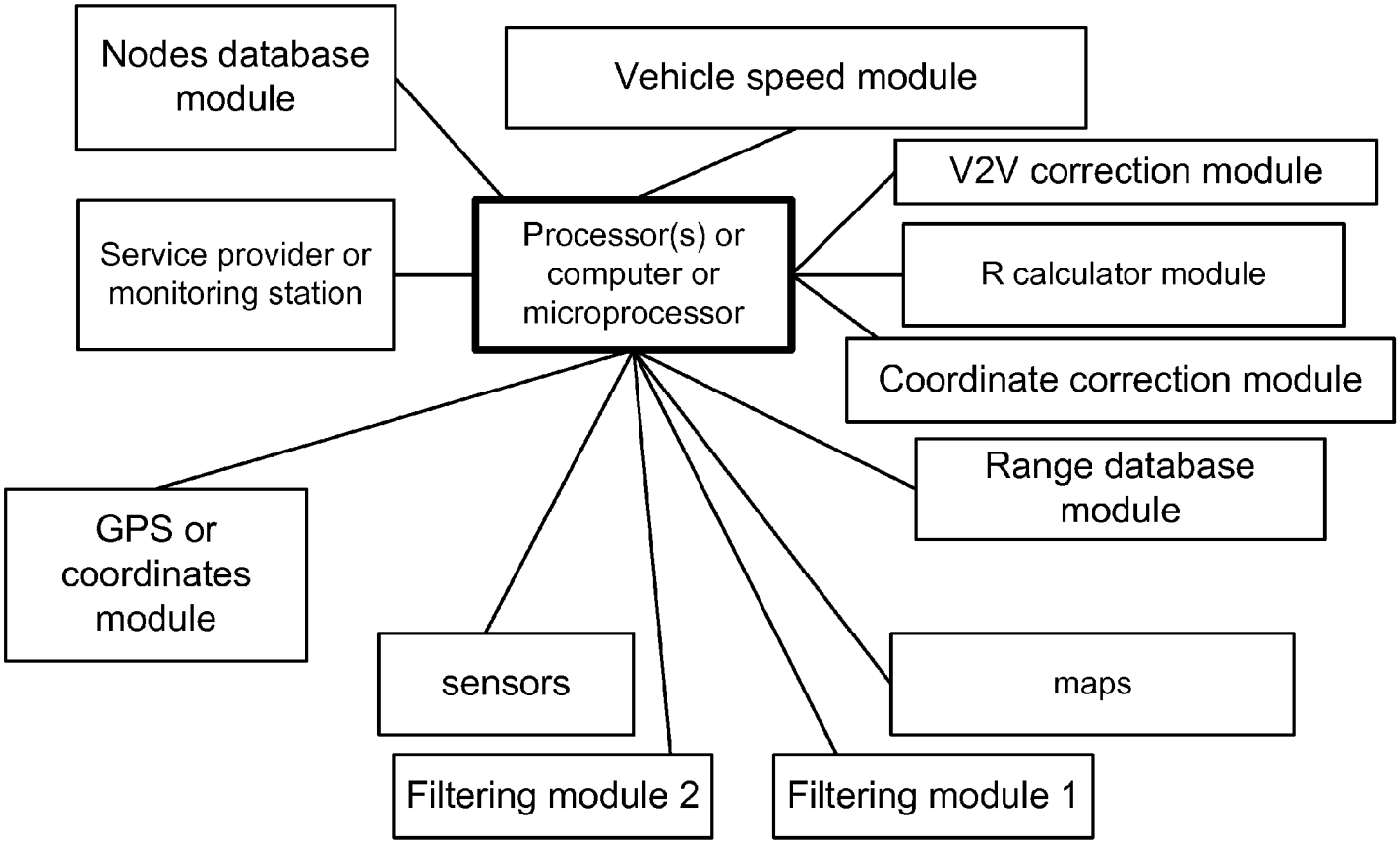
FIG. 12 is for one embodiment of the invention, for a system for automated vehicles, with components, with one or more filtering modules.
Figure 13:
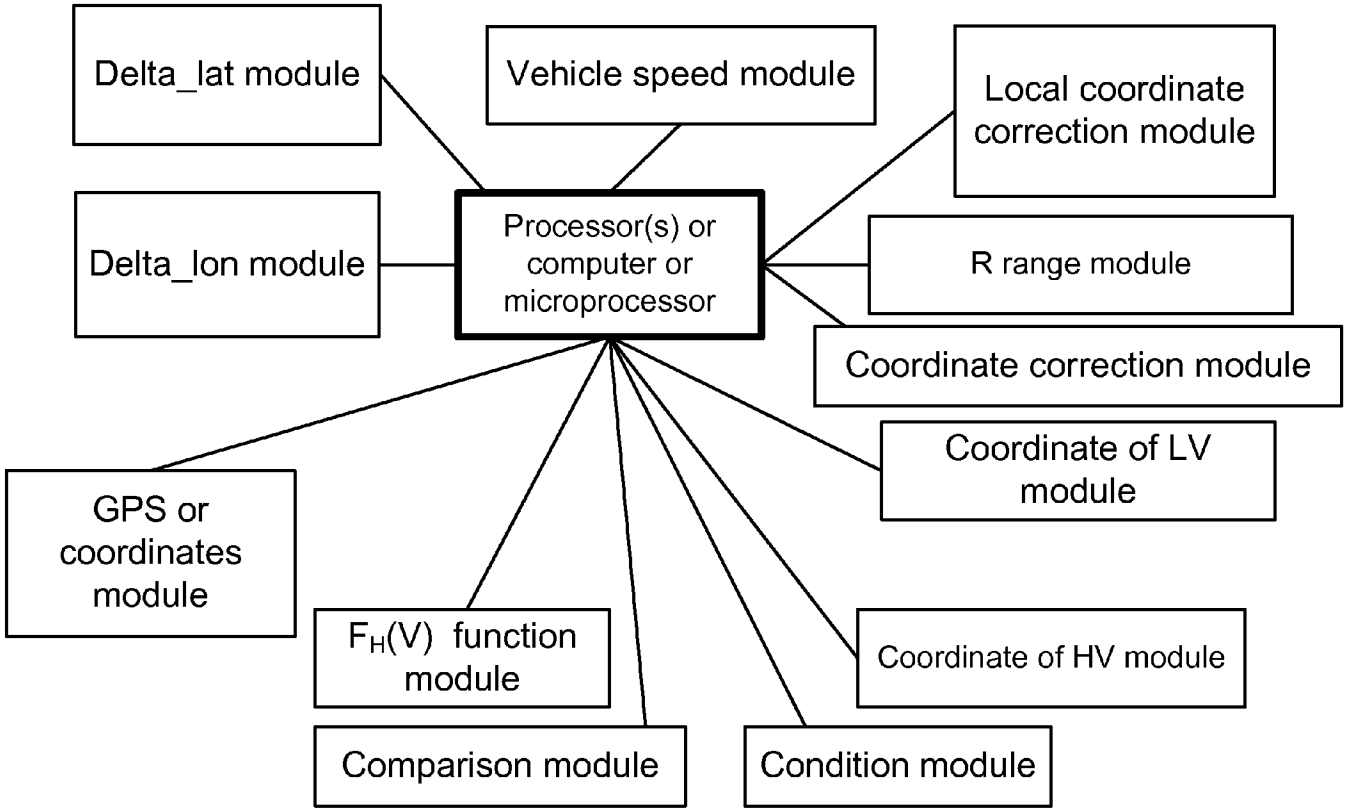
FIG. 13 is for one embodiment of the invention, for a system for automated vehicles, with components, with a function F( ), e.g., depending on the velocity of the vehicle, for calculations for Lat and Lon coordinates, and their corresponding deltas or differences.

FIG. 12 is for one embodiment of the invention, for a system for automated vehicles, with components, with one or more filtering modules, based on coordinates, Rs, GPS, and maps, and their corresponding corrections. FIG. 13 is for one embodiment of the invention, for a system for automated vehicles, with components, with a function F(), e.g., depending on the velocity of the vehicle, for calculations for Lat and Lon coordinates, and their corresponding deltas or differences, with local and global coordinate correction module(s).

Figure 14:
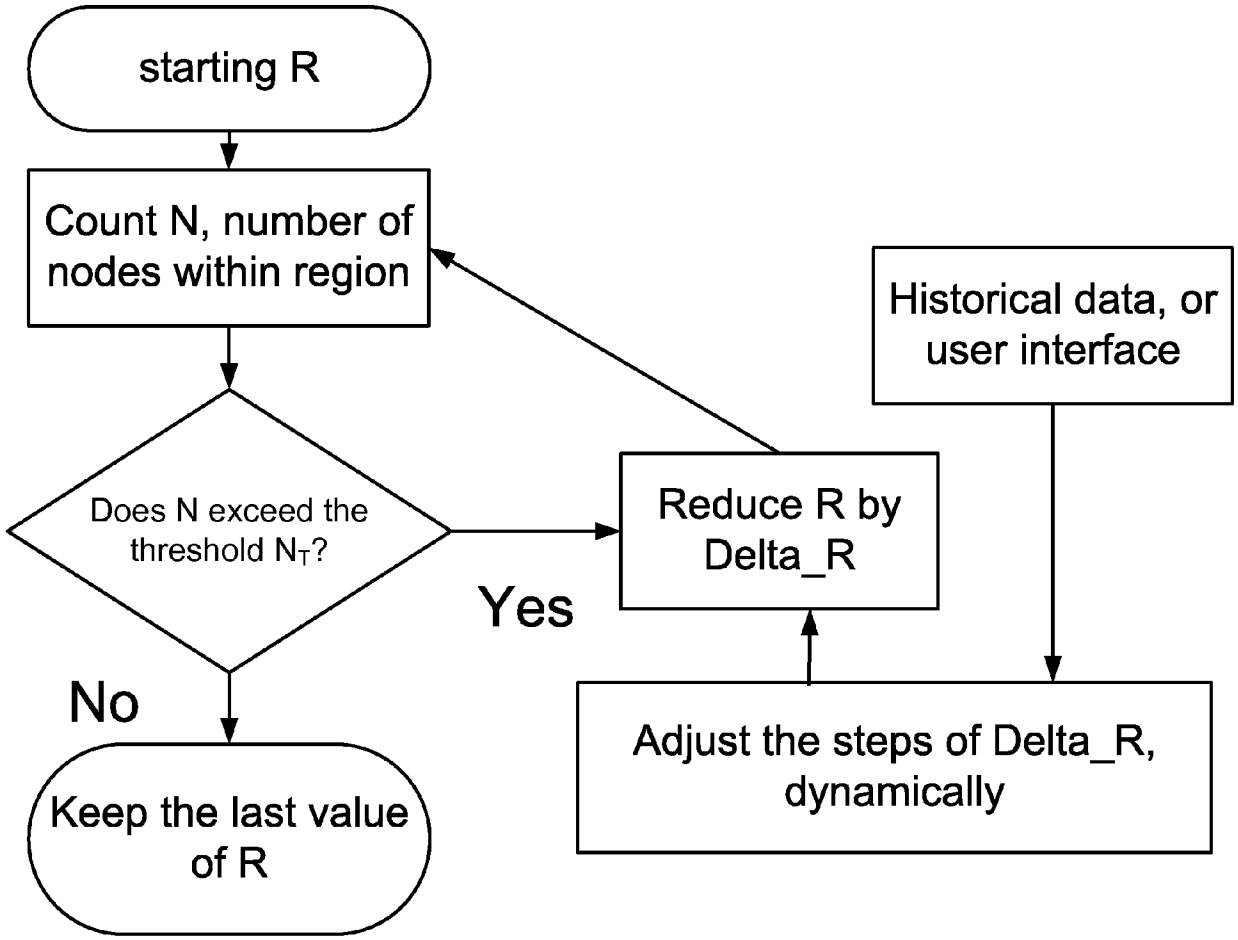
FIG. 14 is for one embodiment of the invention, for a method for automated vehicles, for adjusting R dynamically, based on rules engine, historical data, user-interface, or neural network.
Figure 15:
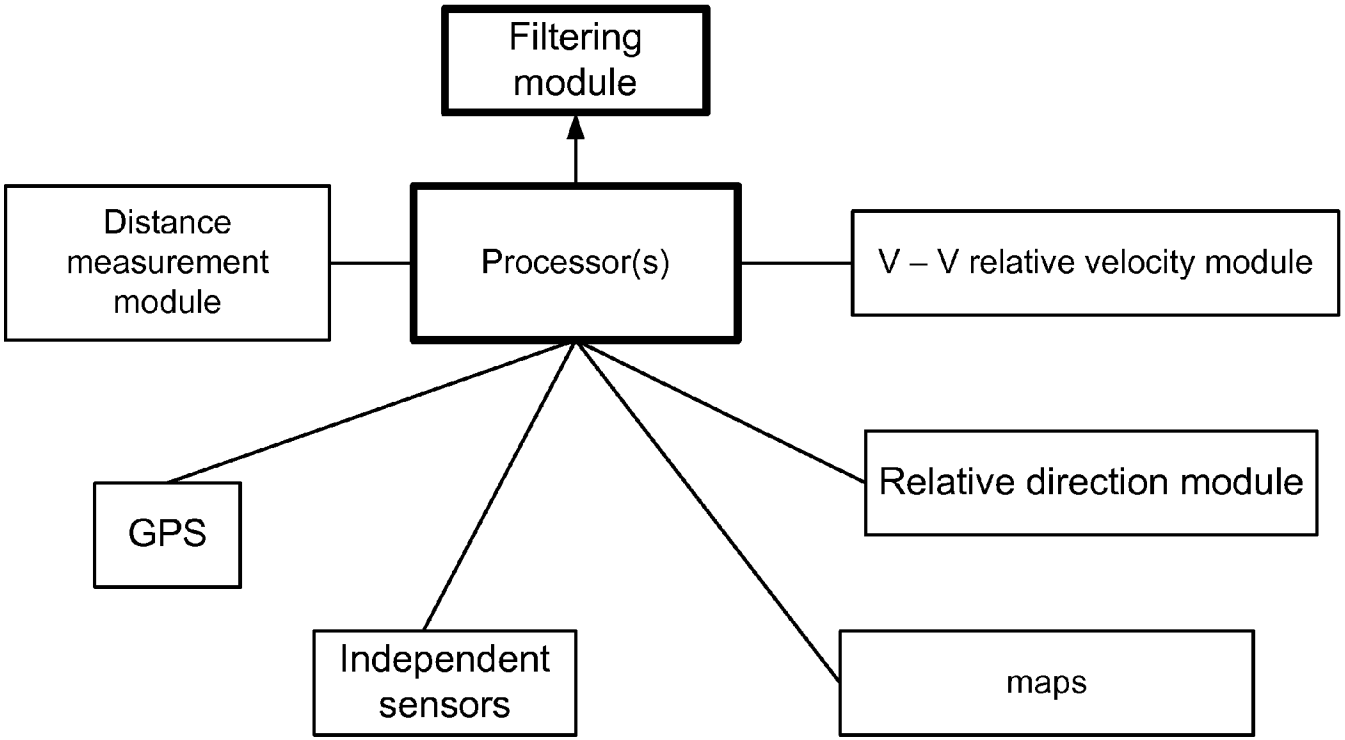
FIG. 15 is for one embodiment of the invention, for a system for automated vehicles, for filtering module, for direction, velocity, and distance.

FIG. 14 is for one embodiment of the invention, for a method for automated vehicles, for adjusting R dynamically, based on rules engine, historical data, user-interface, or neural network, e.g., for filtering purpose. FIG. 15 is for one embodiment of the invention, for a system for automated vehicles, for filtering module, for direction, velocity, and distance, e.g., using independent sensors and GPS.

Figure 16:
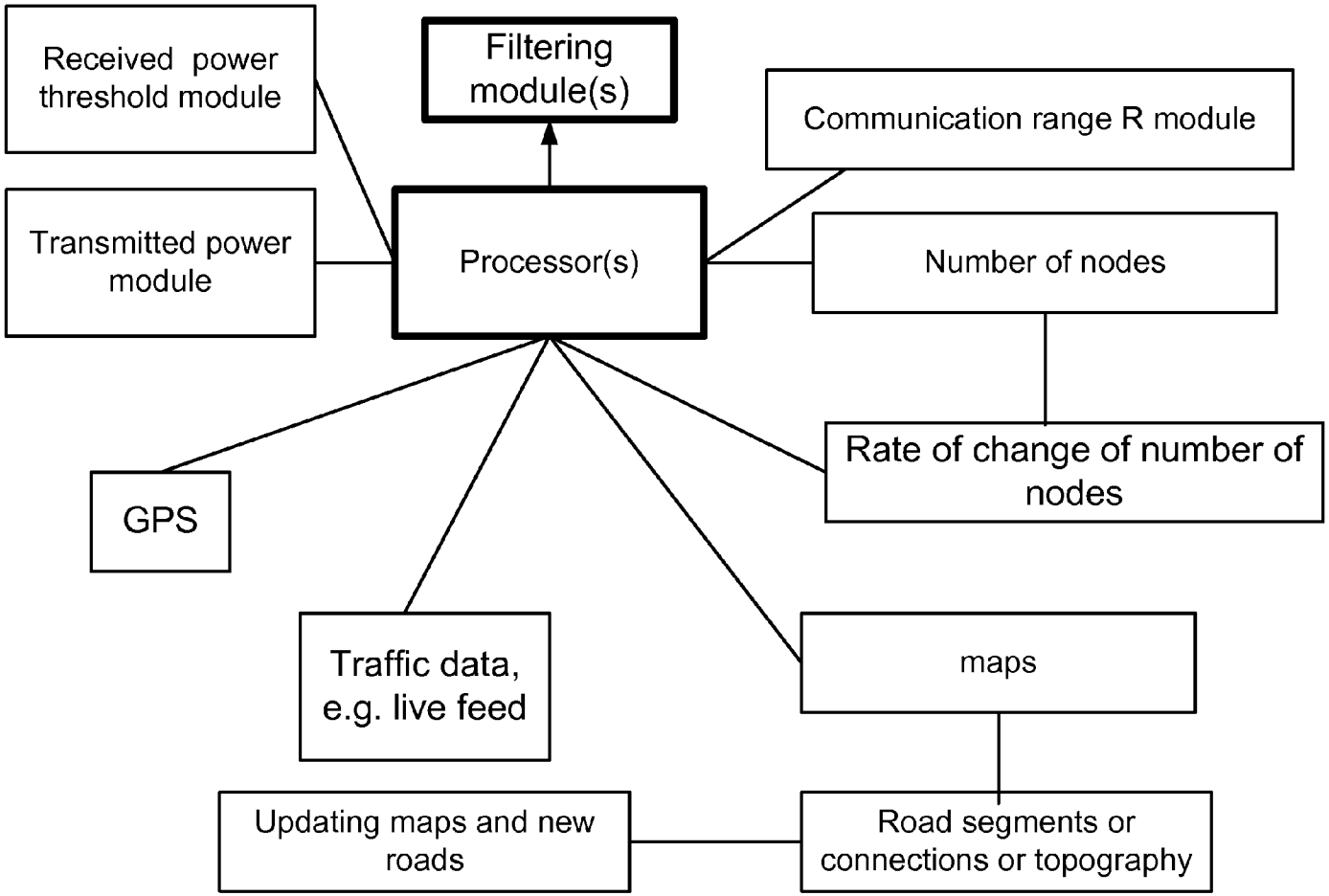
FIG. 16 is for one embodiment of the invention, for a system for automated vehicles, for filtering module, for power, power threshold(s), traffic data, maps, topography, R, number of nodes, and rate of change of number of nodes.

FIG. 16 is for one embodiment of the invention, for a system for automated vehicles, for filtering module, for power, power threshold(s), traffic data, maps, topography, R, number of nodes, and rate of change of number of nodes, with a module for updating the new roads, intersections, and topographies, by user or automatically, as a feed, e.g. periodically or based on an event.

Figure 17:
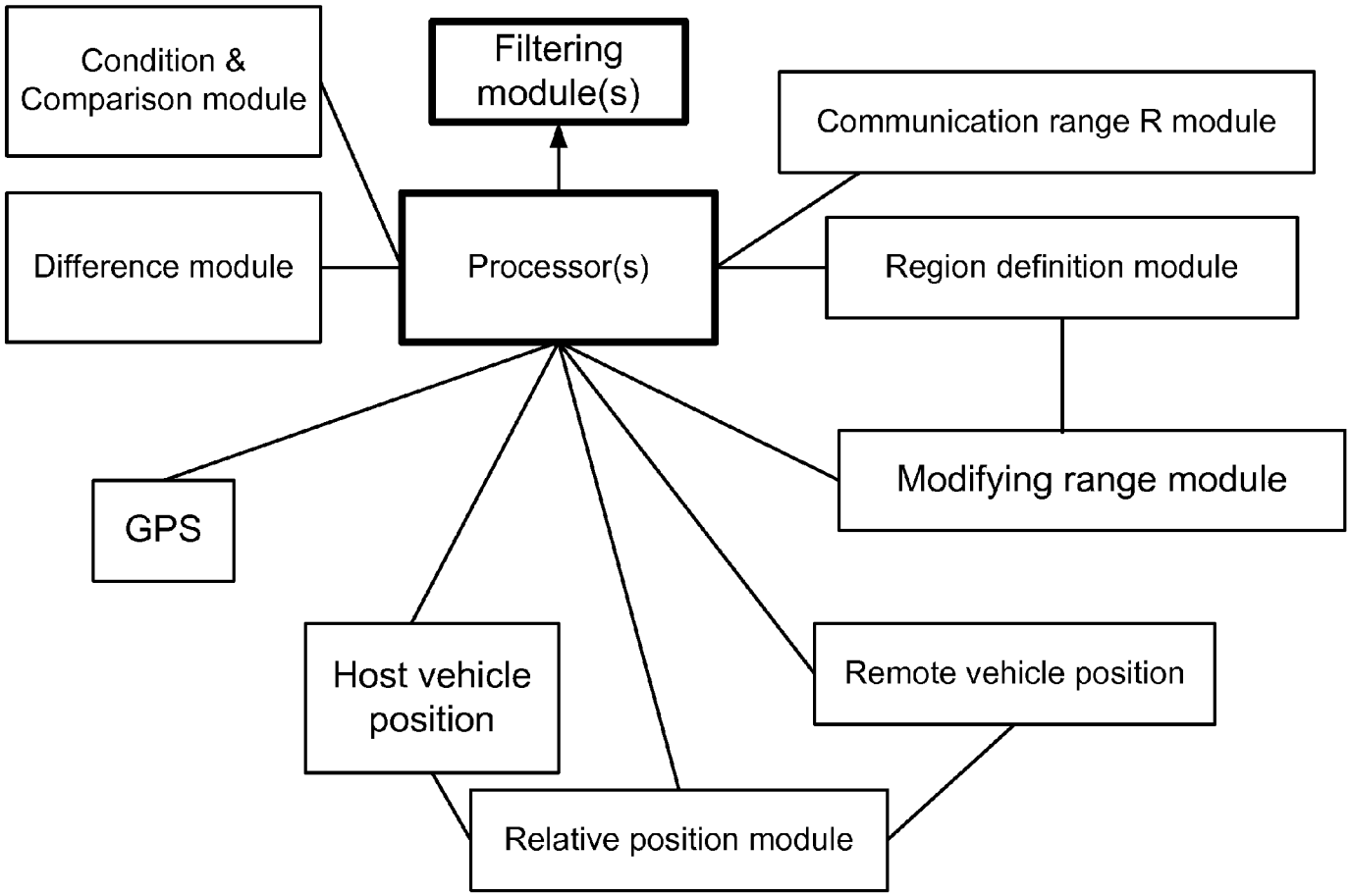
FIG. 17 is for one embodiment of the invention, for a system for automated vehicles, for filtering module, for various vehicles.

FIG. 17 is for one embodiment of the invention, for a system for automated vehicles, for filtering module, for modifying region, for various vehicles, with relative position module and GPS, with condition module, to compare and get all the relevant nodes or vehicles.

Here, we describe a method, as one embodiment: The first level of filtering is based on defining circle (geometry) of interest or any other geometrical shape (see also FIG. 11). For the circular geometry case, the objective is to ignore (not process) all nodes (vehicles) that is outside a calculated radius R (see also FIG. 10). In one embodiment, the R is calculated based on the targeted safety applications combined with vehicle dynamics. For example, FCW (forward collision warning), BSW (blind spot warning), LCA (lane change assist), IMA (intersection movement assist), and CSW can all be implemented using 200 m (meter) radius. In one embodiment, as the vehicle speed decreases, the forward application required coverage range decreases.

In one embodiment, for example, for calculating R, we have (see also FIG. 13):

R, as a function of host vehicle speed, $F_H$, e.g.:

$$R=F_H(V)=50+2V+(V^2/8)$$

Where V is the host vehicle speed in m/s.

In one embodiment, F is a function of velocities, distances, and coordinates, both in absolute values and relative values, for host and other vehicles. In one embodiment, F is a function of polynomial of degree G, in host vehicle speed V. In the example above, we have: G=2.

For example, for: 70 m≤R≤200 m

That is, Maximum (R) =200 m, and

Minimum (R)=70 m.

The 70 meter will still be sufficient to do all the rear applications. These numbers are just examples for some specific applications.

In one embodiment, the next step is to convert this R to delta Longitudinal and delta Latitude from the host vehicle coordinate. The objective here is to ignore all vehicles that are outside a radius. Here, we assumed circular filtering. Different types of geometric filtering can also be done: rectangle, ellipse, other irregular geometry, or any other regions or shapes. For circular filtering, given the current host vehicle (HV) coordinate (lat_HV, lon_HV), and given the desired filtering radius R, then the equivalent delta latitude (Delta lat) and delta longitudinal (Delta_lon), from (lat_HV, lon_HV) for this radius R, are calculated as follows (see also FIG. 13):

$$\text{Delta_lat}=(R/\text{Radius_of_earth})=(R/6378137),$$

e.g., based on Earth Equatorial radius of 6378137 m, and where R is in meter (m).

$$\text{Delta_lon}=\arcsin(\sin(\text{Delta_lat})/\cos(\text{lat_}HV))$$

Therefore, in one embodiment, to apply the filtering algorithm for any node (Remote Vehicle (RV)), with the coordinate of (lat_RV, ion_RV), the following is executed (see also FIG. 13, for Comparison Module and Condition Module):

If $$\text{Abs}(\text{lat_}RV-\text{lat_}HV)>\text{Delta_lat}$$

OR $$\text{Abs}(\text{lon_}RV-\text{lon_}HV)>\text{Delta_lon}$$

Then: Ignore it (i.e., do not process it).

Else: Process it.

Wherein all "lat" and "lon" values are expressed in radian. The default value for R is 200 m, but it is configurable. For jam reduction and reduction of processing, in one embodiment, we want to ignore all the vehicles outside of the radius R.

Now, in one embodiment, this value of R can be adaptively adjusted based on the statistical distribution of the nodes ranges (see also FIG. 12). For example, if the maximum number of nodes that can be processed is 150, and the calculated R=200 m, and the number of nodes in the 200 m radius is 200 nodes, but most of those nodes are close to the 200 m range, then the R value can be adaptively adjusted (reduced), so we get close to the 150 desired total numbers of nodes. For example, this can be done in small steps with ΔR, in a loop, reducing the value of R slightly, each time (in each step), and measuring the nodes or vehicles within the new radius, and the process continues, until we get 150 nodes or less in that radius, and then we exit the loop, and stop the process (see also FIG. 14). Then, we select the final radius as the radius for the formulation and next steps.

In one embodiment, the second level of filtering is based on the relative velocity between the host vehicle and the remote vehicle. For example, for all remote vehicles that have a value of the velocity component in host vehicle direction that is greater than the host vehicle velocity, and they are also at relatively high range distance from the host vehicle, then they constitute no immediate threat on the host vehicle (based on the probability) (see also FIG. 15). Thus, those vehicles can be filtered out.

In one embodiment, the third level of filtering is to adjust either the transmitted power and/or the received power threshold as a function of one of the following (as different embodiments) (see also FIG. 16):

a. Rate of change in the number of received nodes. As the number of nodes increases sharply, the host vehicle is approaching a congested traffic area, and therefore, the transmitted power can be decreased to reduce the communication range, and/or the received power threshold can be increased to reduce the receiving communication range (see also FIG. 16).

b. The map database can also be used very effectively: For example, if the number of connected road segments to the host vehicle road segment is high, and/or the total number of road segments is high within a defined area, then the transmitted power can be decreased, and/or the received power threshold can be increased (see also FIG. 16).

c. Based on the calculated R. For example, communication range R decreases/increases, as the transmission power increases/decreases (see also FIG. 16).

In one embodiment, the fourth level of filtering is just using the map database: For example, filter all the nodes (vehicles) that are on road segments that are not connected to the host vehicle road segment. An example for that is the main road and an overpass geometry. The main road and the overpass that passes over it are not connected, and thus, they do not make a V2V (vehicle to vehicle) possible traffic hazard. Map database can provide this information that these two road segments are not connected (see also FIG. 16).

The advantages of our methods are very clear over what the current state-of-the-art is. Our methods optimally use the available processing power and available bandwidth on processing the data of the desired nodes, which are relevant or important. They also help reducing the communication congestion problem.

Please note that the attached Appendices (for the current and parent applications) are also parts of our teaching here, with some of the technologies mentioned there developed fully within our company, and some with prototypes, for which we seek patent protection in this and future/co-pending divisionals or related cases or continuations.

In this disclosure, any computing device, such as processor, microprocessor(s), computer, PC, pad, laptop, server, server farm, multi-cores, telephone, mobile device, smart glass, smart phone, computing system, tablet, or PDA can be used. The communication can be done by or using sound, laser, optical, magnetic, electromagnetic, wireless, wired, antenna, pulsed, encrypted, encoded, or combination of the above. The vehicles can be car, sedan, truck, bus, pickup truck, SUV, tractor, agricultural machinery, entertainment vehicles, motorcycle, bike, bicycle, hybrid, or the like. The roads can be one-lane county road, divided highway, boulevard, multi-lane road, one-way road, two-way road, or city street. Any variations of the above teachings are also intended to be covered by this patent application.

The invention claimed is:

1. A method for selecting road side equipment for controlling vehicles in a highway or street, said method comprising:

a central computer receiving a total value which indicates number of road side equipment pieces that a first vehicle is able to receive data from;

said central computer determining a type of data a first road side equipment piece transmits or supports;

said central computer receiving a location of said first road side equipment piece from an input device;

a certification device or module examining security validation of a certificate for said first road side equipment piece;

said central computer receiving a location of said first vehicle;

said central computer receiving dynamics information about said first vehicle;

said central computer receiving a location of a second vehicle near said first vehicle from a location determination device or module;

said central computer analyzing said total value which indicates number of road side equipment pieces that said first vehicle is able to receive data from, said type of data said first road side equipment piece transmits or supports, said location of said first road side equipment piece, said security validation of said certificate for said first road side equipment piece, said location of said first vehicle, said dynamics information about said first vehicle, and said location of said second vehicle near said first vehicle; and said central computer selecting said first road side equipment piece based on said analyzing step.

2. The method for selecting road side equipment for controlling vehicles in a highway or street as recited in claim 1, said method comprises:

using relative geometric data.

3. The method for selecting road side equipment for controlling vehicles in a highway or street as recited in claim 1, said method comprises:

anticipating said first vehicle's travel trajectory.

4. The method for selecting road side equipment for controlling vehicles in a highway or street as recited in claim 1, said method comprises:

using said first vehicle's speed and direction.

5. The method for selecting road side equipment for controlling vehicles in a highway or street as recited in claim 1, said method comprises:

releasing a lock on said first road side equipment piece.

6. The method for selecting road side equipment for controlling vehicles in a highway or street as recited in claim 1, said method comprises:

transiting a lock to a second road side equipment piece.

7. The method for selecting road side equipment for controlling vehicles in a highway or street as recited in claim 1, said method comprises:

incorporating a security validation factor.

8. The method for selecting road side equipment for controlling vehicles in a highway or street as recited in claim 1, said method comprises:

filtering a second road side equipment piece.

9. The method for selecting road side equipment for controlling vehicles in a highway or street as recited in claim 1, said method comprises:

using range, down-range and cross range values.

10. The method for selecting road side equipment for controlling vehicles in a highway or street as recited in claim 1, said method comprises:

using map data.

11. The method for selecting road side equipment for controlling vehicles in a highway or street as recited in claim 1, said method comprises:

ordering a second road side equipment piece, with respect to said first road side equipment piece.

12. The method for selecting road side equipment for controlling vehicles in a highway or street as recited in claim 1, said method comprises:

using a back distance and front distance with respect to said first vehicle.

13. The method for selecting road side equipment for controlling vehicles in a highway or street as recited in claim 1, said method comprises:

detecting and filtering a duplicate road side equipment piece.

14. The method for selecting road side equipment for controlling vehicles in a highway or street as recited in claim 1, said method comprises:

detecting a point of interest.

15. The method for selecting road side equipment for controlling vehicles in a highway or street as recited in claim 1, said method comprises:

determining intersecting path for remote vehicles with said first vehicle.

16. A method for selecting road side equipment for controlling vehicles in a highway or street, said method comprising:

a central computer receiving data from a first road side equipment and a second road side equipment among multiple road side equipment;

said central computer receiving criteria for filtering said multiple road side equipment;

filtering said multiple road side equipment based on said criteria;

wherein said criteria comprises derived relative geometric data between a first vehicle and said first road side equipment and said second road side equipment;

wherein said criteria further comprises said first vehicle's data;

wherein said first vehicle's data comprises said first vehicle's heading;

wherein said criteria further comprises a cross range value, plus a range value measured from said first vehicle;

detecting a third road side equipment and a fourth road side equipment, among said multiple road side equipment, which comprises same message as that of said first road side equipment;

iteratively discarding said third road side equipment and said fourth road side equipment, based on said cross range value and said range value measured from said first vehicle.

17. The method for selecting road side equipment for controlling vehicles in a highway or street as recited in claim 16, said method comprises:

detecting points of interest, based on said first vehicle's and a second vehicle's intersecting paths.

18. The method for selecting road side equipment for controlling vehicles in a highway or street as recited in claim 16, said method comprises:

selecting a fifth road side equipment which is close to forward region that results from intersecting a second vehicle's path with said first vehicle's path.

19. The method for selecting road side equipment for controlling vehicles in a highway or street as recited in claim 16, said method comprises:

ordering said multiple road side equipment based on said multiple road side equipment's location and said first vehicle's dynamics.

20. The method for selecting road side equipment for controlling vehicles in a highway or street as recited in claim 16, said method comprises:

filtering said multiple road side equipment based on map data and said first vehicle's dynamic data;

considering a fifth road side equipment as a road side equipment candidate of interest, if said first vehicle's position is located inside said map region.

21. The method for selecting road side equipment for controlling vehicles in a highway or street as recited in claim 16, said method comprises:

filtering a fifth road side equipment that is located farthest from a point of interest.

22. The method for selecting road side equipment for controlling vehicles in a highway or street as recited in claim 16, said method comprises:

determining a fifth road side equipment of interest, based on intended driving of said first vehicle's path, which is determined by lane matching, lane properties, and lane connection.

23. The method for selecting road side equipment for controlling vehicles in a highway or street as recited in claim 16, said method comprises:

filtering a fifth road side equipment, based on number of hops to arrive to said fifth road side equipment.

24. The method for selecting road side equipment for controlling vehicles in a highway or street as recited in claim 16, said method comprises:

locking, release, and switching said multiple road side equipment;

matching position for map data and relative map data, with respect to a current road side equipment and a candidate road side equipment.

25. The method for selecting road side equipment for controlling vehicles in a highway or street as recited in claim 16, said method comprises:

using a predicted vehicle position for said first vehicle.

26. The method for selecting road side equipment for controlling vehicles in a highway or street as recited in claim 16, said method comprises:

selecting a fifth road side equipment, based on a security certificate download.

27. The method for selecting road side equipment for controlling vehicles in a highway or street as recited in claim 16, said method comprises:

selecting a fifth road side equipment, which has highest probability to stay longest time in communication with an on-board unit in said first vehicle.

28. The method for selecting road side equipment for controlling vehicles in a highway or street as recited in claim 16, said method comprises:

using a cost function which comprises parameters for relative location of a fifth road side equipment, with respect to said first vehicle, said first vehicle's dynamics, said first vehicle's speed, strength of communication signal, or behavior of data over time.

* * * * *